United States Patent [19]

Evans

[11] 4,211,292

[45] Jul. 8, 1980

[54] BOREHOLE ANGLE CONTROL BY GAGE CORNER REMOVAL EFFECTS

[76] Inventor: Robert F. Evans, 631 Honeywood La., La Habra, Calif. 90631

[21] Appl. No.: 928,703

[22] Filed: Jul. 27, 1978

[51] Int. Cl.[2] ..... E21B 7/08

[52] U.S. Cl. ..... 175/61; 175/73; 175/93

[58] Field of Search ..... 175/61, 73, 76, 93, 175/380, 398, 339, 325

[56] References Cited

U.S. PATENT DOCUMENTS

| | | | |
|---|---|---|---|
| 2,317,010 | 4/1943 | Wingard | 175/398 |
| 2,329,393 | 9/1943 | Davis | 175/380 |
| 2,886,293 | 5/1959 | Carr et al. | 175/339 |
| 2,956,781 | 10/1960 | Eastman | 175/325 |
| 3,043,381 | 7/1962 | McNeely, Jr. | 175/73 |
| 3,092,188 | 6/1963 | Farris et al. | 175/61 |
| 3,231,030 | 1/1966 | Blom | 175/380 |
| 3,424,256 | 1/1969 | Jeter et al. | 175/76 |
| 3,595,326 | 7/1971 | Claycomb | 175/73 |
| 4,040,494 | 8/1977 | Kellner | 175/61 |

*Primary Examiner*—James A. Leppink
*Attorney, Agent, or Firm*—John R. Ley

[57] ABSTRACT

The advancement angle of a borehole cut by a rotary drill bit of the type which forms a cylindrical sidewall, a drill face and a circumferentially extending gage corner, is controlled by removing a different amount of the gage corner material over a selected partial arc of the gage corner circumference during each rotation of the drill bit. The different amount of material removed causes the remaining arc of the gage corner circumference to apply a slight lateral force on the drill bit, thus forcing the drill bit in a desired direction. Gage corner removal apparatus include selectively extendable cutter devices, a hinged connector hingeably connecting the drill bit to the end of the drill string, a pivotable single cutting wheel member, a hydraulic fluid jet impinging upon the gage corner, and apparatus for delivering additional drillable particles to the gage corner. Selectively activating the gage corner removal apparatus during each of a plurality of subsequent drill bit revolutions results in a cumulative angle change effect. Control apparatus is attached to the drill string at a position at which gravity induced sag causes the drill string to contact the low side portion of the borehole. The control apparatus is arranged for deriving energy from contact and rotation of the drill string relative to the low side portion. The energy derived activates the gage corner removal apparatus.

64 Claims, 29 Drawing Figures

FIG. 17
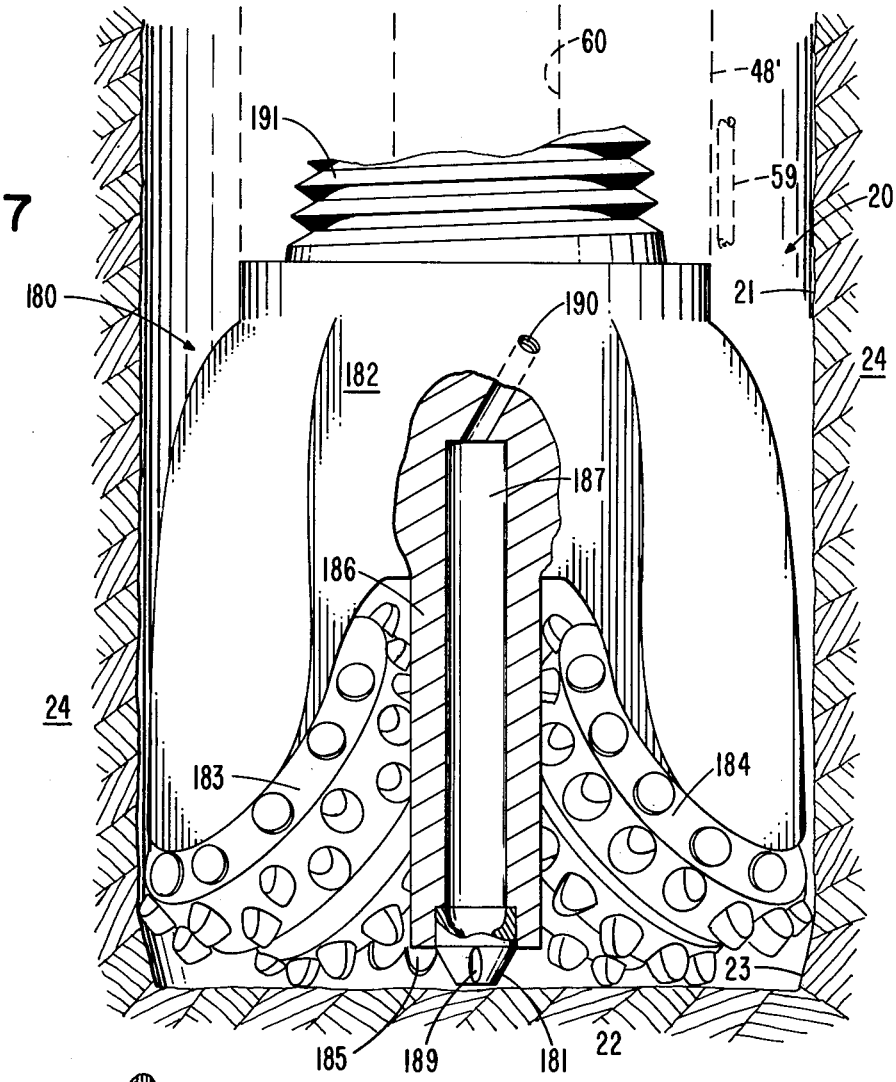
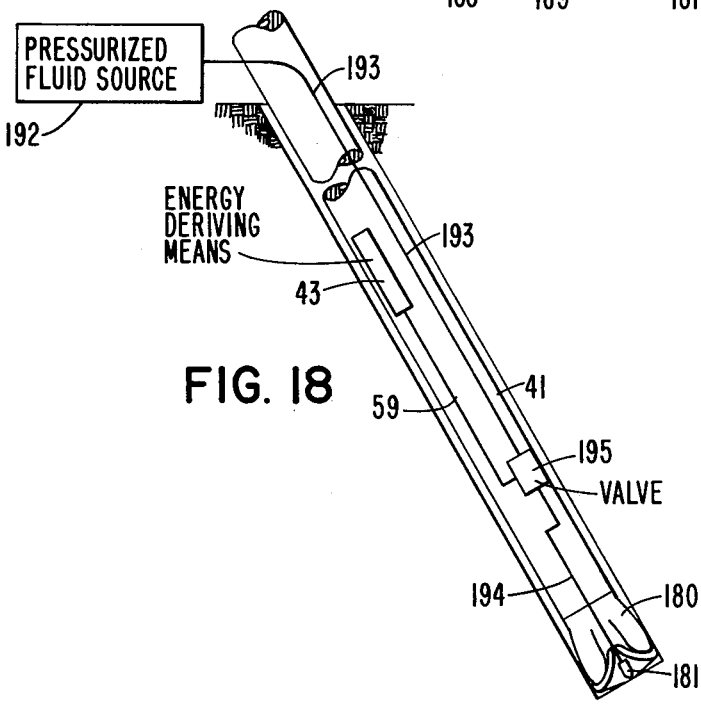
FIG. 18

BOREHOLE ANGLE CONTROL BY GAGE CORNER REMOVAL EFFECTS

BACKGROUND OF THE INVENTION

1. Field of the Invention

This invention relates to and is useful for selectively controlling the angle of a well hole or a borehole as it is cut through earth material or the like. More particularly, the present invention relates to controlling the advancement angle of a borehole by selectively removing a different amount of material over a selected partial arc of a gage corner formed by a rotary drill bit.

2. Brief Introduction and Description of Prior Art

A variety of different methods and arrangements to control the advancement angle of a borehole are known and conventionally employed. Although the majority of these approaches are successful and reliable, certain disadvantages are inherent. Usually, changing or controlling the borehole deviation or advancement angle requires use of special drill bits, support collars, and special methods of drilling. In each case, the conventional drill bit and drill string must be pulled from the borehole and the special equipment inserted. After achieving the desired angle change, the special equipment is removed and use of the conventional equipment is resumed. Of course, each time an angle change is made, there is an obvious loss of drilling penetration rate while the special equipment is inserted, used and then removed. Control and guidance equipment is typically required for conventional angle change apparatus and methods and this equipment is generally very expensive and may require the presence of specially trained personnel to operate and control the equipment. Since a major factor in drilling well holes is time consumed, it is important to maintain a good drilling or penetration rate and to minimize the time when actual drilling does not proceed. Reducing the costs involved in making angle changes with conventional equipment is a further important factor in reducing the total cost of drilling boreholes.

Other disadvantages and limitations are known and appreciated by those knowledgeable in the art. Many of these prior art disadvantages and limitations can be overcome or significantly minimized by the present invention.

OBJECTS OF THE INVENTION

It is the major object of this invention to provide new and improved methods and apparatus for controlling the advancement angle of a well hole or borehole cut by a rotary drill bit. Another object is to teach a new and improved approach to controlling the advancement angle of a borehole by removing very small amounts of material from a partial arcuate portion of the circumference of a gage corner portion of the borehole during a plurality of revolutions of the drill bit, resulting in a gradual and acceptable angle change.

Another objective is to maintain acceptable and normal rates of drilling penetration while simultaneously controlling the advancement angle of the borehole. Still another object is to obtain positive and reliable control over the change in advancement angle and to accomplish such with relative inexpensive, self-effectuating and reliable methods and apparatus.

Further objects are to utilize certain reliable elements of conventional drill bits and drilling apparatus to control the borehole advancement angle, to selectively control the drilling effect of the drill bit during each revolution in a consistently predictable manner, to simplify the apparatus needed to control and change the advancement angle of the borehole, to minimize the need for special equipment and specially trained personnel to effect changes in the borehole angle, to obtain and apply angle controlling forces and energy without sophisticated sensors, control arrangements and the like, and to further teach a method of controlling the deviation angle of a borehole from vertical to be inherently self-correcting. Other advantages and achievements of the present invention will be apparent to those knowledgeable in the art.

SUMMARY OF THE INVENTION

The present invention involves rotary drill bits having cutting elements which cut a well hole or borehole defined by an axially extending cylindrical sidewall, a drill face extending essentially transversely with respect to the cylindrical sidewall and a gage corner extending circumferentially around the drill face and radially outward at an inclination from the drill face to the sidewall. To control the advancement angle, a different amount of material is removed over a selected partial arc of the circumference of the gage corner, as compared to that amount removed over the remaining partial arc of the circumference of the gage corner. The arcuate portion over which less material has been removed applies a slight lateral force to the drill bit in the radial direction in which it is desired to angle the borehole.

Means associated with the drill bit for removing the different amount of material from the gage corner are selectively activated to achieve the effect over a partial interval of each rotation of the drill bit. One arrangement for actuating the gage corner removal means involves control and energy deriving apparatus attached on the drill string at a predetermined position at which gravity induced sag causes the drill string to contact with the low side portion of the borehole. The energy deriving apparatus derives energy from rotation of the drill string relative to the stationary low side of the borehole sidewall. The energy is derived in pulses of duration related to the partial interval of drill string rotation during which the energy deriving apparatus contacts the sidewall. The energy pulses are applied to control the gage corner removal means. The preselected arc of the circumference of the gage corner over which the different amount of material is removed corresponds or is related to the interval of rotation during which energy is derived. The angular positional relationship between the gage corner removal means and the energy deriving means is selected to achieve a desired direction of angle advancement relative to the stationary low side portion of the sidewall.

The gage corner removal means include a number of embodiments. A rolling cutter wheel and an abrasion shoe are embodiments of cutting members which are selectively activated to an extended position for contacting and removing an additional amount of material over the selected arc of the gage corner circumference. Means for emitting a hydraulic fluid jet impinging on the gage corner is an embodiment which removes an additional amount of material and increases the effectiveness of the drill bit cutting elements over the selected arc of the gage corner circumference. A hinged connecting apparatus hinges the drill bit with respect to the drill string to place the cutting elements of the drill bit into a more effective cutting position over the selected arc of the gage corner circumference. A single cutter wheel rotating about an axis extending at intersecting angles with respect to radial and axial axes of the drill bit is pivoted to a condition in which the rotational axis of the wheel is angled slightly less with respect to the axial axis of the drill bit, thereby forcing the cutting elements of the single cutting wheel into more effective cutting contact with the gage corner. Particle delivery means delivers additional drillable particles over a preselected arc of the gage corner circumference to inhibit or reduce the normal cutting effectiveness of the drill bit over that arcuate portion and to allow normal drill bit effectiveness over the remaining arcuate portion.

The present invention is defined in the appended claims. A more complete understanding of the invention can be obtained from the following description of a preferred embodiment and from the drawings consisting of a number of figures.

BRIEF DESCRIPTION OF THE DRAWINGS

FIG. 7 is a transverse section view taken substantially in the plane of line 7—7 of FIG. 6.

FIG. 8 illustrates a piston and cylinder activation means, and FIG. 9 illustrates an electrical solenoid activation means.

FIG. 17 is a side elevational view of a drill bit including means for selectively emitting a hydraulic fluid jet impinging on a gage corner of the borehole. A portion of the drill bit is broken away in section to illustrate the hydraulic fluid jet emitting means. The drill bit is shown connected to a drill collar illustrated in phantom and inserted within an axially sectioned borehole.

FIG. 18 is a schematic illustration of one embodiment of control and energy deriving apparatus utilized in conjunction with the bit shown in FIG. 17.

DETAILED DESCRIPTION OF PREFERRED EMBODIMENTS

By way of general introduction, control over the advancement angle of a borehole as it is cut or advanced through earth material or the like is achieved by effects created in a particular type of well hole or borehole. The characteristics of the borehole, as well as a discussion of one well known rotary drill bit having cutting elements arranged for cutting a borehole having these characteristics, is discussed in a first section below. To control the advancement angle, a different amount of earth material is removed over a partial selected arcuate portion of the circumference of a gage corner portion of the borehole, as compared to the amount of material removed over the remaining arcuate portion of the circumference of the gage corner. As a result of selective material removal, lateral forces induced by portions of the borehole force the drill bit to angle in a desired manner. A discussion of the general concepts and method of removing material from the gage corner and the advancement angle control effects created are discussed in the second section below. To achieve substantial angle control effects, it is necessary to remove the different amount of material over the selected arcuate portion of the circumference of the gage corner during each revolution of a number of sequential revolutions of the drill bit. The selected arc should be approximately consistent in angular duration and angular position relative to the borehole from one revolution to the next. A control and energy deriving arrangement for achieving these effects is discussed in the third section below. Lastly, various embodiments of means associated with the drill bit and the drilling apparatus for removing the gage corner material are discussed separately in a number of individually designated sections appearing at the end of this detailed description.

Rotary Drill Bit and Borehole Characteristics

Figure 1:
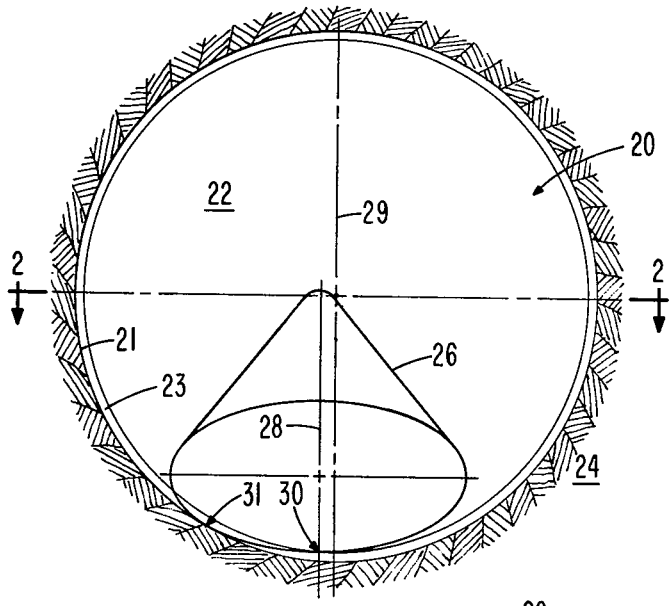
FIG. 1 is a top view looking axially into a borehole of the type to which the present invention relates and which is formed by a schematically illustrated cone cutter assembly.
Figure 2:
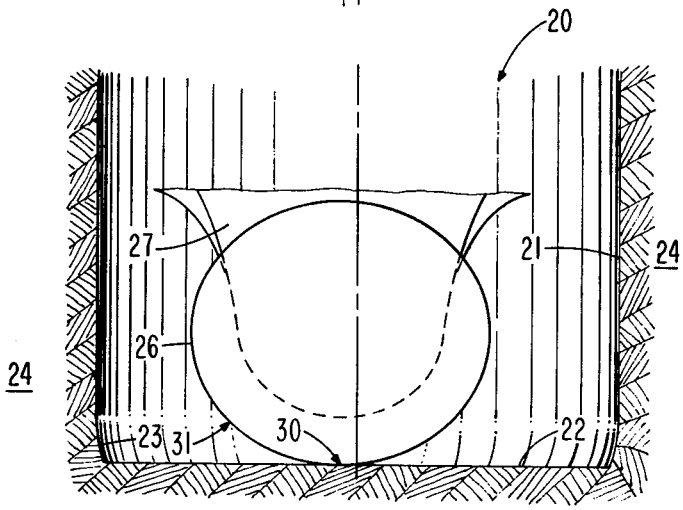
FIG. 2 is an axially extending section view taken substantially in the plane of line 2—2 of FIG. 1 and schematically illustrating the maximum circumference of the radial outermost cutting wheel element of the cone cutter assembly.

The characteristics of the borehole to which the present invention relates, and one type of rotary drill bit which effectively cuts a borehole having these characteristics, are known in the art. Referring to FIGS. 1 and 2, a borehole 20 is shown to include a cylindrical sidewall portion 21 which extends generally coaxially with the axis of the borehole, a drill face portion 22 extending essentially transversely with respect to the cylindrical sidewall portion 21, and a gage corner portion 23 which extends circumferentially around the outer periphery of the drill face 22 and radially outward at an inclination to the sidewall 21. Of course, the sidewall and drill face and gage corner portions are defined by the surrounding earth material 24 as the borehole 20 is cut. It is to rotary drill bits which cut a gage corner portion 23 of the borehole that this invention relates, in certain aspects.

One commonly used and very effective type of rotary drill bit which cuts a borehole having the sidewall 21 and drill face 22 and gage corner 23, is the well-known offset three-cone bit, one example of which is disclosed more fully in U.S. Pat. No. 2,148,372 to Garfield. An offset three-cone bit utilizes three groups of rolling cutting wheels and cutting elements, and each group or cutting assembly is formed in a general overall shape of a cone. Each of the cone-shaped cutting assemblies is offset, meaning that the rotational axis of each assembly extends at a slight intersecting angle or in spaced parallel relation with respect to a radial reference from the axial and rotational center of the drill bit. In both cases, the cone assembly axis does not pass through the bit axis. It is this offset geometry which causes the cone cutter assemblies to cut or leave the gage corner 23 as the borehole is cut. One offset cone cutter assembly 26 is schematically illustrated in FIGS. 1 and 2. A bit support structure 27 positions the cone cutter assembly 26 with its axis 28 of rotation offset in spaced parallel relation to a radial reference 29 extending from the axial and rotational center of the bit support structure 27. A description of the intersecting-angle geometry of an offset cone cutter assembly is present in the above identified Garfield patent. Both types of offset geometry are well known in the art.

The effect of the offset geometry is to create the gage corner portion 23, as can be generally understood from FIGS. 1 and 2. Due to the offset of each cone cutter assembly 26, the point 30, which is axially or vertically below the axis 28 of rotation of the cone cutter assembly 26, is spaced a slight radial distance inward with respect to the cylindrical sidewall 21. Another point 31 circumferentially displaced from the point 30 is the point at which the rotating cone cutter assembly 26 cuts the maximum diameter or gage of the borehole 20, and thus, also defines the cylindrical sidewall 21. As seen in FIG. 2, the point 31 is axially displaced from the drill face 22 and from the point 30. Because point 30 is located radially inward with resepect to point 31 due to the geometry of the offset cone cutter assembly 26, a sloping or inclined gage corner 23 is formed between the point 31 at maximum diameter of the cylindrical sidewall and the point 30 at the maximum diameter of the drill face. The material between points 30 and 31 is typically curved, and it is this material which defines the gage corner 23. The cutting elements radially inwardly spaced from the point 30 on the cone cutter assembly 26 remove particles of material 24 to define the drill face 22.

The advantages of an offset three-cone rotary drill bit are well known. The offset geometry of the cone cutter assemblies achieves a combination of rolling and scraping action on the earth material defining the drill face and gage corner. The rolling and scraping action removes particles of material much more effectively and more quickly than if the offset geometry was not utilized. Due to the prove advantages of the offset three-cone bit, it is expected that such a bit will be utilized in either a substantially original or slightly modified form in practicing the present invention. It should be understood, however, that other types of rotary drill bits which cut a circumferential gage corner extending at an inclination outward from the drill face to the sidewall are within the scope of the present invention.

The substantial advantage to utilizing the offset three-cone bit or a similar bit in practicing the invention is that no reduced effectiveness or loss of penetration rate occurs as the borehole is cut and simultaneously angled in the desired manner. Many prior art approaches of controlling the advancement angle of the borehole require removal of the conventional drill bit and insertion into the borehole of special cutting devices and the like. Other prior art approaches involve stopping the rotation of the drill bit and attached drill string while an auxiliary cutting effect takes place. In most prior art appraoches, alterations in structure of the bit or in the way in which the bit is operated in terms of revolutions per minute, weight on the bit or hydraulic cuttings removal are required, and these alterations adversely affect performance and the drilling penetration rate.

Maintaining a good drilling rate is particularly important because of the economics involved in drilling and in angling or correcting the direction of a borehole. The extra drill rig time consumed, the cost of extra or special tools, and the cost of extra and specialized skilled personnel can amount to a considerable expense with the currently used approaches to angle control.

Angle Control

Figure 3:
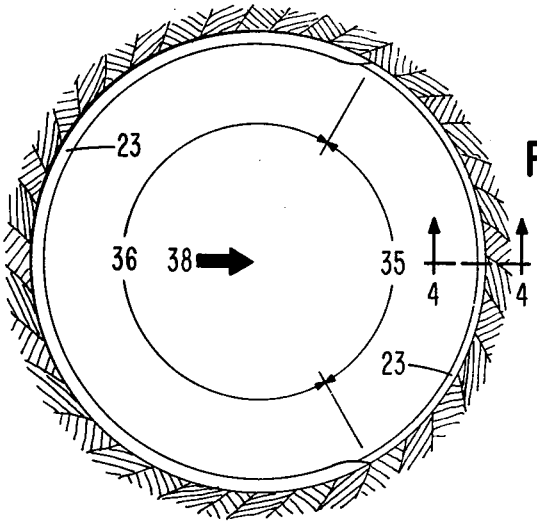
FIG. 3 is a top view similar to FIG. 1 illustrating a selected partial arcuate portion of the circumference of the gage corner and a remaining arcuate portion of the circumferential gage corner.
Figure 4:
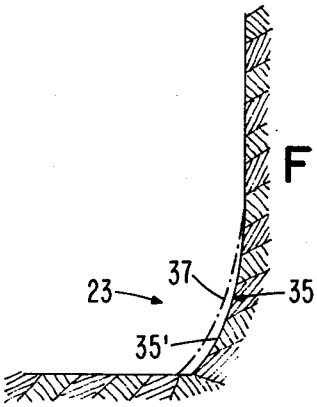
FIG. 4 is an enlarged fragmentary section view illustrating removal of a different amount of the gage corner of the borehole, taken in an axially extending section plane of line 4—4 of FIG. 3.

To control the angle of advancement of the borehole cut by the rotary drill bit, a different amount of material is removed over a partial preselected arc of the circumference of the gage corner than the amount of material removed over the remaining partial arc of the circumference of the gage corner. FIGS. 3 and 4 schematically illustrate this angular control concept. The partial preselected arc is referenced 35 in FIG. 3, and the remaining arc of the circumference of the gage corner 23 is referenced 36. FIG. 4 illustrates in exaggerated condition an additional amount of material removed from the preselected arc 35. The dotted lines 37 indicate, for comparison purposes, a normal amount of material which would normally define the gage corner resulting from normal operation of the drill bit. By removing additional material to a level indicated by the solid line 35', the size and radial inclination of the gage corner 23 is slightly reduced over the arc 35. However, the size and inclination of the gage corner material in the remaining arc 36 is that normally cut by the rotary drill bit, represented at 37. Consequently, the remaining arc 36 of the gage corner extends radially inward at the full or normal inclination.

The remaining partial arc 36, being of full normal size and inward inclination, applies a slight radially inward directed or lateral force on the drill bit in the general radial direction of the selected arc 35. The slight lateral force is illustrated by a vector referenced 38. In time after a sufficient number of drill bit revolutions, the lateral force applied with each revolution effectively forces the drill bit in the direction of the vector 38. The drill bit begins to advance laterally in the direction of vector 38, and the advancement angle of the borehole is changed.

The manner in which one arcuate portion of the inclined gage corner 23 applies lateral force on the drill bit to control the advancement angle is somewhat similar in overall effect to a whipstock effect known in the art to occur when a conventional drill bit encounters a sloping geological formation of different hardness. The whipstock effect simply describes a naturally-occurring physical result, in contrast to the present invention, which selectively and positively creates angle control effects on the drill bit. One description of the whipstock effect and a further description of the offset three-cone drill are found in an article appearing in *Drilling,* May, 1965, Page 34.

The amount of material removed with each revolution over the preselected arc need not be large to control the advancement angle. In fact, very small amounts will achieve acceptable angular control. Removal of a very small amount over the preselected arc during each of a plurality of subsequent revolutions creates anistropic action sufficient to achieve significant angular deviation. As an example, it is possible to change the angle of the borehole advancement by approximately 1° by forcing the drill bit laterally by an amount of two to three thousandths of an inch during the course of drilling 100 feet. It is apparent, therefore, that by operating the drill bit and creating different gage corner removal effects over a sufficient time period, sizeable angle deviation build-up will occur and effective control over the advancement angle of the borehole results. Such drilling rates are not difficult to obtain and can be achieved without sacrificing the normal adequate performance of the rotary drill bit.

It should also be noted that in addition to removing an additional amount of material over that which would normally be removed, as is the situation illustrated in FIG. 4, the concept of the present invention also involves inhibiting the removal of a normal amount of gage corner material over one partial arc while allowing normal removal of the material over the remaining partial arc. Of course, the overall effect of either removing additional material or inhibiting normal removal of material is the same: a lateral force is applied to the drill bit by the arcuate portion of the gage corner circumference over which the greater amount of material remains, and the drill bit is angled appropriately.

To inhibit normal removal of material from the gage corner, additional drillable material is supplied to the gage corner over a partial arc of its circumference so that the cutting elements of the drill bit primarily cut the additional drillable materials rather than the material of the gage corner. Over the other remaining arc of the gage corner, the cutting elements of the drill bit operate in the normal manner to remove a normal amount of material. Thus, a different amount of the gage corner is removed over one arcuate portion as compared to the other remaining arcuate portion.

To achieve suitable angle control, the different amount of material must be removed over the preselected arc during each a number of sequential revolutions. Furthermore, the angular positions of the beginning and ending points of the preselected arc must be approximately the same during each revolution of the drill bit so that the lateral force 38 is applied approximately in the same lateral direction to the drill bit during each revolution. One advantageous arrangement for achieving this effect is next described.

Control and Energy Deriving Arrangement

To remove the different amount of material over the preselected arc, gage corner removal means are associated with the rotary drill bit. The gage corner removal means are activated during a selected partial interval of one or each rotation of the drill bit, to remove the different amount of material from the gage corner over the selected arc. It is therefore important to activate and deactivate the gage corner removal means at approximately the same rotational positions during each drill bit rotation. The interval of rotation during which the gage corner removal means is activated corresponds in angular duration to the selected arc of the circumference of the gage corner over which the different amount of material is removed.

One control arrangement for activating the gage corner removal means is to provide a control means at the surface of the earth which is operatively connected for activating the gage corner removal means over the preselected arc. Such control means employs sensors or the like for determining the rotational position of the drill bit as it is continually rotated, and selectively supplies energy to the gage corner removal means during the selected and predetermined interval of drill bit rotation.

A more appropriate control means for activating the gage corner removal apparatus by deriving energy from rotation of the drill string relative to the borehole sidewall is illustrated in FIGS. 5 to 9. The borehole 20 shown in FIG. 5 extends axially downward at an angle with respect to a vertical reference. A rotary drill bit 40 is attached to the end of a drill string 41 and inserted into the borehole. The drill string 41 comprises a plurality of conventional drill collars 48 connected together in a manner known in the art. The drill bit 40 is attached to the end of the drill string and placed in contact with the drill face 22 of the borehole. The drill string 41 extends through the borehole 20 to the surface of the earth where conventional drilling apparatus 44 is connected to the drill string for rotating the drill string and the drill bit connected at the end of the drill string. Of course, rotating the drill bit at the drill face cuts and removes particles of the material 24 to advance the borehole.

Because the drill string 41 extends at an angle with respect to a vertical reference, gravity bends or induces the drill string toward the low side portion of the cylindrical sidewall of the borehole. The gravity induced sag in the drill string causes it to contact the low side portion of the sidewall at a point 42 axially spaced from the drill face and drill bit. Means, generally referenced 43, are fixed to the drill string at point 42 for the purpose of deriving energy from rotational movement of the drill string relative to the stationary cylindrical sidewall over a selected partial interval of each rotation of the drill string during which the means 43 contacts the low side portion of the sidewall. Of course, the distance between the drill bit and the point 42 will vary depending upon a number of factors including the angle of the borehole 40 with respect to a vertical reference and the stiffness of the drill collars comprising the drill string.

Figure 6:
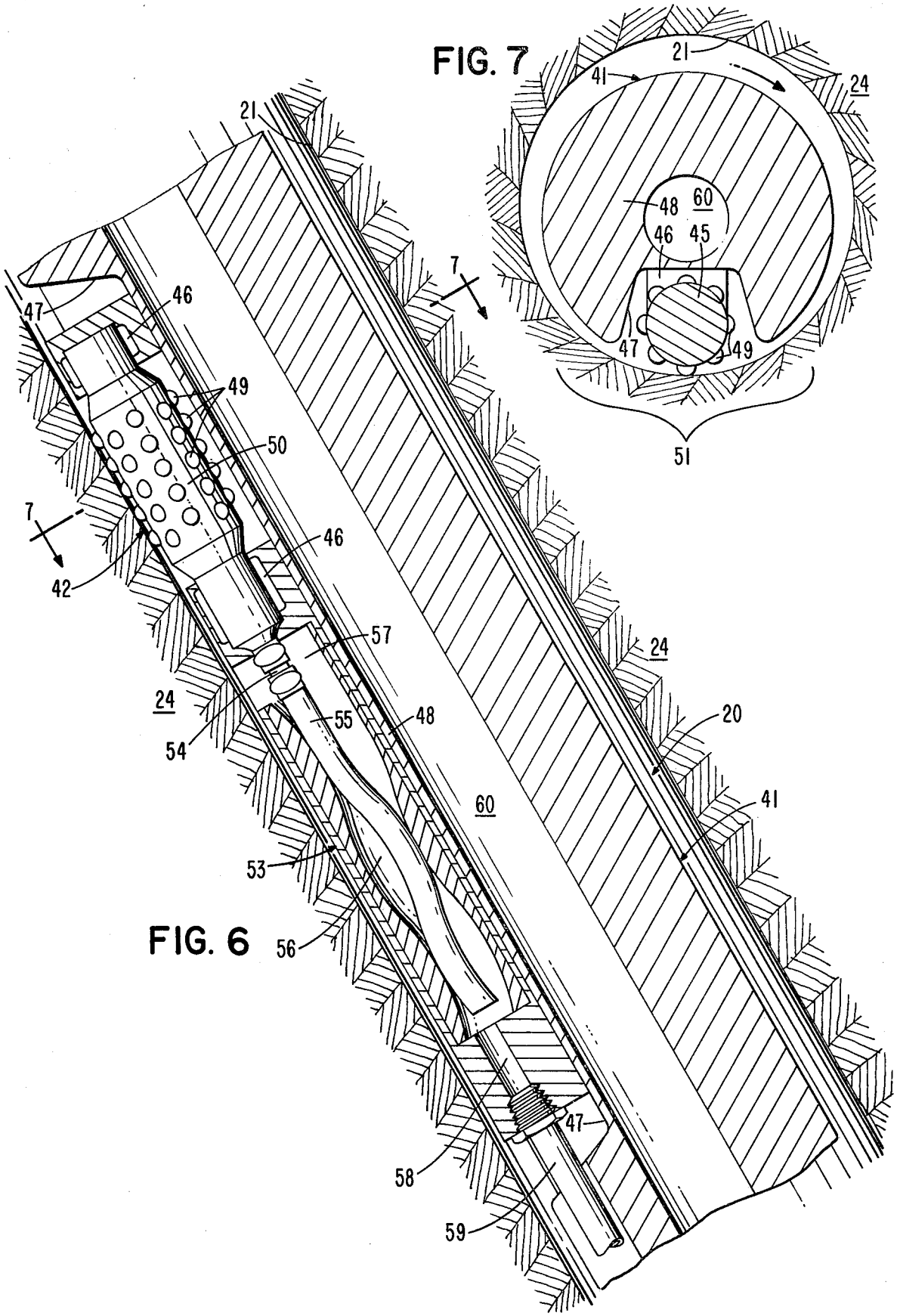
FIG. 6 is an axially extending section view taken substantially in the plane of line 6—6 of FIG. 5, in which the drill string and control and energy deriving apparatus have been rotated 180°.

One example of means 43 for deriving energy is illustrated in FIGS. 6 and 7. A roller member 45 or other driver means is fixed in an exposed condition to the exterior surface of the drill string 41. Conventional bearing connection means 46 attach the roller member 45 to the drill string, and the bearings 46 allow the roller member to rotate relative to the drill string. The roller member 45 and bearings 46 are received within a milled pocket 47 formed in the exterior surface of a drill collar 48 comprising a portion of the drill string 41. Teeth 49 or other frictional engagement members extend from an outer cylindrical surface 50 of the roller member 45. The teeth 49 of the roller member are exposed at the outer periphery of the drill string and are thus free to contact and roll against the low side portion of the sidewall 21 at the point 42. The teeth 49 are made of conventional wear-resistant material. A conventional drilling fluid passage 60 extends axially through the drill collar 48 and the drill string 41.

As the drill string 41 rotates, the roller member 45 is periodically rotated into contact with the low side portion 51 of the cylindrical sidewall 21, as is shown in FIG. 7. During contact with the low side portion 51, the teeth 49 contact the sidewall 21, and the rotation of the drill string relative to the stationary sidewall causes the roller member 45 to rotate about its bearing connection means 46. With further drill string rotation, the roller member 45 moves to a position at which the teeth 49 no longer contact the cylindrical sidewall. Thus, roller member 45 contacts and rolls against the low side portion 51 of the cylindrical sidewall during a predetermined partial interval of drill string rotation, and, during the remaining partial interval of the drill string rotation, the roller member 45 avoids contact with the sidewall 21. This periodic contact results because the axial center of the drill string does not coincide with the axial center of the borehole 20 due to the sag induced by gravity.

Thus, the roller member is rotated during a selected partial interval of the drill string rotation and is not rotated during the remaining partial interval of drill string rotation. Rotation occurs at the same rotational position of the drill string during each revolution, since the roller member is at a fixed position and the low side portion 51 presents a stationary surface upon which the roller member periodically contacts and rolls against.

Rotational movement of the roller member 45 is applied to an energy generator means to generate energy. As shown in FIG. 6, a hydraulic pump 53 such as a conventional Moyno pump is operatively connected by connection means 54 to be rotated by the roller member. The connection means 54 transmits rotation from the roller member 45 to the pump 53 and rotates a screw-like rotor member 55 within a helical shaped stator 56. An intake opening 57 at one end of the stator 56 receives fluid utilized by the pump 53. The fluid is forced through a series of progressive cavities formed by interaction of the rotating rotor member 55 and stationary stator 56, and the fluid is pressurized and delivered from an outlet opening 58 of the pump 53. A conduit 59 connected at the outlet 58 of the pump conducts the pressurized fluid for use by the gage corner removal means associated with the drill bit. The conduit 59 extends along the exterior of the drill string 41 preferably within a milled channel, not shown, or extends within the interior of the drill string. The supply of hydraulic fluid for the pump 53 is obtained from the outflow of fluid and particle cuttings flowing out of the borehole between the drill string and the cylindrical sidewall or from drilling fluid in the passage 60, as will be described. The outflow of fluid and particle cuttings between the drill string and the sidewall is established by directing a flow of drilling fluid through the passage 60 in the drill collars of the drill string and directing the drilling fluid from wash jets of the drill bit onto the drill face. The particles cut and removed by the drill bit are thus washed away from the drill face and out of the borehole, as is conventional in the art.

It is apparent from the foregoing description of the energy deriving means 43 that the pump 53 supplies energy only when rotated by the roller member 45. The roller member 45 is rotated only during the partial interval of each rotation of the drill string when the roller member contacts and rolls against the low side portion of the cylindrical sidewall. Therefore, the energy is supplied in the form of pulses delivered during the time interval that the roller member contacts and rolls against the cylindrical sidewall.

Figures 5, 8, 9:
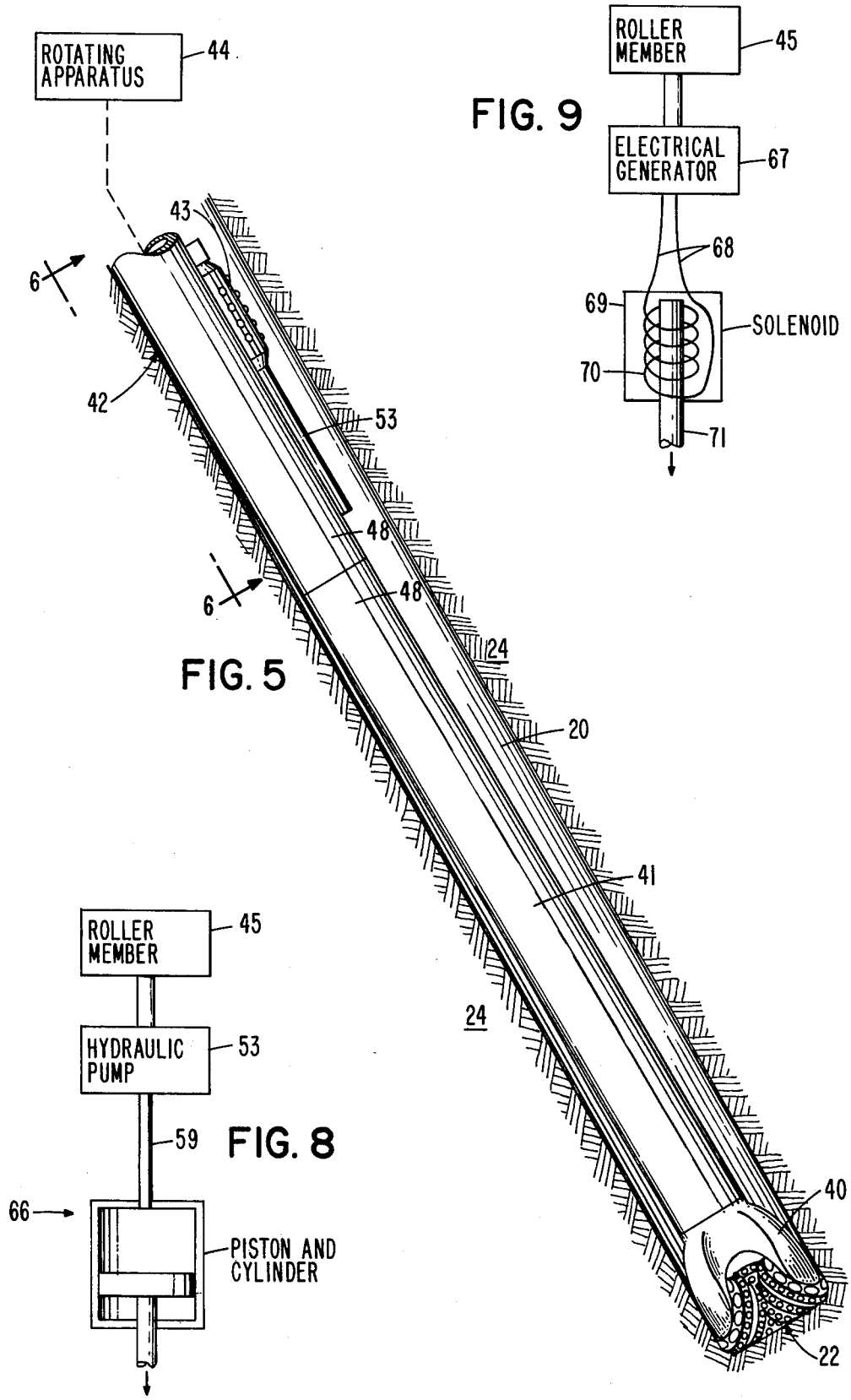
FIG. 5 is an axially sectioned view of a borehole extending at an angle from a vertical reference into which a drill string and drill bit have been inserted, and a schematic view of a control and energy deriving means of the present invention.
FIGS. 8 and 9 are schematic illustrations of actuating means associated with the control and energy deriving apparatus of the present invention. Specifically.

The energy pulses are utilized for operatively controlling the removal of the different amount of material over the selected partial arc of the circumference of the gage corner. The energy pulses activate the gage corner removal means associated with the drill bit. One example of activation means utilizing the hydraulic pressure pulses is a piston and cylinder arrangement 66 schematically illustrated in FIG. 8. The pulses of pressurized hydraulic fluid are supplied to the piston and cylinder arrangement 66 and force the piston to move. Another example of activation means is illustrated in FIG. 9. The roller member 45 is operatively connected to operate an electrical generator 67. Electrical energy derived from the operating generator 67 is supplied over conductors 68 to a solenoid arrangement 69. The solenoid includes a conventional coil 70 for producing electromagnetic flux which acts on and moves a magnetic armature 71. Both the piston shown in the FIG. 8 arrangement and the armature shown in the FIG. 9 arrangement include biasing means to return these moveable elements to the original position after the pulse of energy terminates.

In the described manner, energy is derived from rotation of the drill string relative to the cylindrical sidewall by energy deriving means 43. The energy derived is applied to activation means, such as the piston and cylinder arrangement 66 or the solenoid arrangement 69. In other cases the energy derived may be directly applied to the gage corner, in which circumstance the energy deriving means also functions as activation means.

The activation means is operatively associated with the gage corner removal means. Upon activation, the gage corner removal means selectively removes the different amount of material over the preselected partial arc of the circumference of the gage corner. The gage corner removal means is preferably activated only so long as the pulse of energy is applied. The pulse of energy is applied during the interval of drill string rotation time that the roller member 45 contacts the low side portion 51 of the sidewall. The interval of drill string rotation corresponds or bears a predetermined relationship to the angular duration of the preselected arc. By adjusting the predetermined angular positions of the gage corner removal means and the energy deriving means a physical relationship is established between the stationary low side portion 51 of the borehole and the direction in which it is desired to angle the borehole. As explained, the direction in which the borehole will be angled is determined by the angular position over which a different amount of material is removed from the preselected arc. The predetermined arc can be located in any angular position relative to the low side of the borehole sidewall to advance the borehole at a desired angle. By selecting the proper angular relationship of the roller member 45 and the gage corner removal means, an arrangement for automatically correcting any significant deviation of the borehole from vertical is obtained.

Although one roller member 45 has been illustrated connected to the drill string, it may prove advantageous to employ three equally circumferentially spaced rollers about the outer exterior surface of the drill string. Three equally spaced rollers would reduce lateral force impulses supplied to the drill string as each roller rotates into contact with the low side portion of the sidewall. The three equally spaced rollers have a smoothing effect since one of the rollers would prebably be in contact with the low side portion at all times. All three rollers could be connected to separate hydraulic pumps or electrical generators. The output energy of each electrical generator or pump could be appropriately controlled or delivered for use in controlling a drilling operation of the nature described. Energy deriving means can be employed at a number of different axial distances from the drill bit. An appropriate control arrangement controls the gage corner removal means by energy derived from selected ones of the energy deriving means.

Rolling Cutting Wheel

Figure 10:
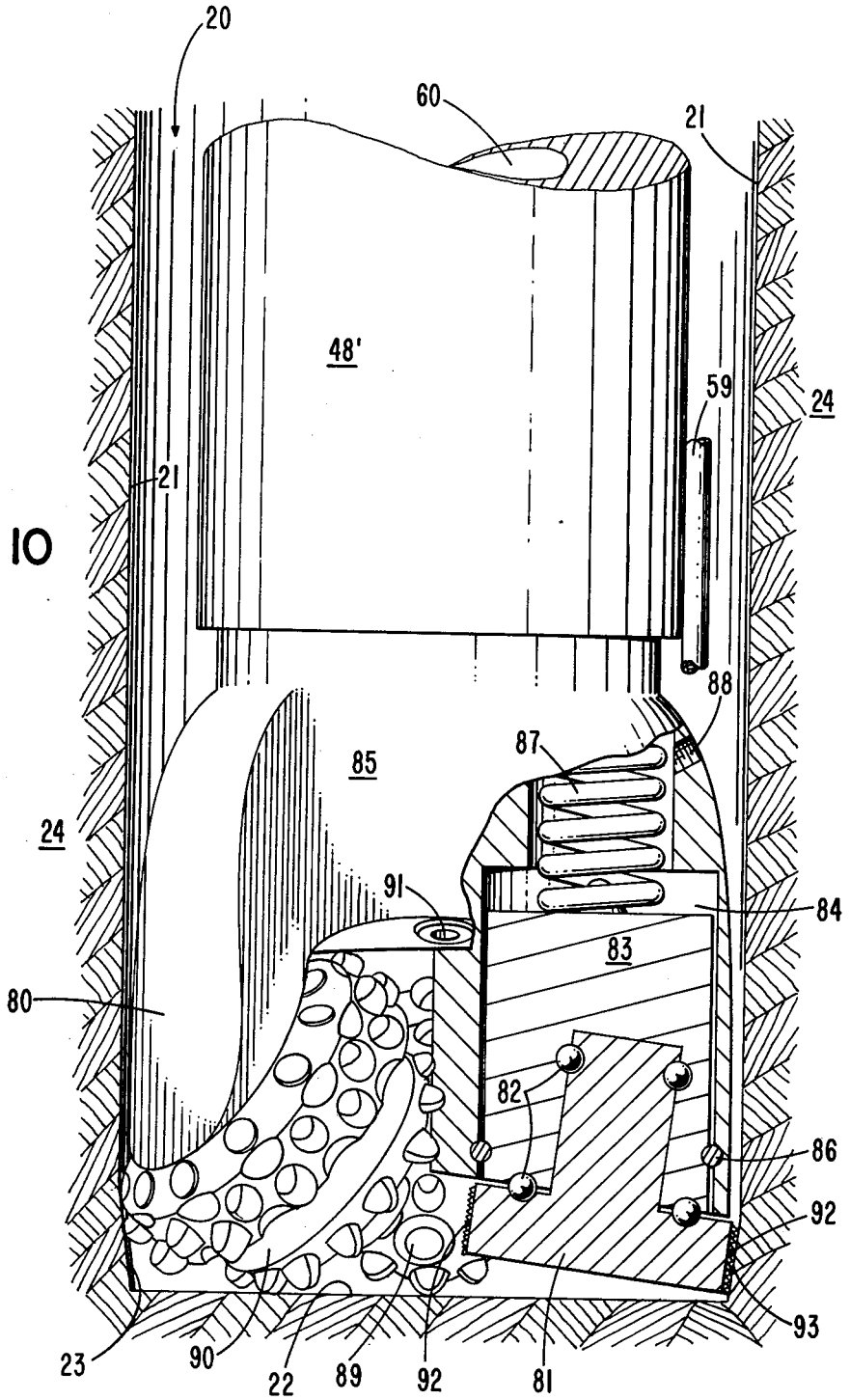
FIG. 10 is a side elevational view of a drill bit with a portion broken away in partial section to illustrate a selectively extendable rolling cutter wheel. The drill bit is shown attached to a drill collar and positioned in an axially sectioned borehole.

A drill bit 80 shown in FIG. 10 includes gage corner removal means in the form of a cutter member which is selectively extendable to substantially contact and cut or remove an increased amount of material from the gage corner 23 over the partial selected arc. The cutter member is in the form of a rolling cutter wheel 81 attached by a plurality of conventional ball bearings 82 to a sliding piston member 83. The sliding piston member 83 is received within an axially extending piston chamber 84 formed in a support structure 85 for the drill bit and its elements. A fluid tight connection is provided by a seal 86 intermediate the sliding piston member 83 and the piston chamber 84. A tension spring 87 extends from the sliding piston member 83 to the bit support structure 85 and biases the piston member toward a retracted (upward) position. The conduit 59, which extends from the hydraulic pump 53 of the energy deriving means 43, is connected by a conventional fitting, not shown, into an inlet opening 88 to the piston chamber 84. Upon delivery of the pressurized fluid pulses through the conduit 59 into the piston chamber 84, the pressurized pulses force the piston to a projected (downward) position. The rolling cutter wheel 81 attached to the sliding piston member 83 is correspondingly forced in an axially downward position into substantial cutting contact with the gage corner material. At the termination of the pressure pulse, the tension spring 87 returns the piston member 83 and attached rolling cutter wheel 81 to the retracted position. The piston member is thus one form of extendable means which moves to projected and retracted positions. The piston member 83 and chamber 84 form one example of activation means.

Two conventional offset cone cutter assemblies 89 and 90 are employed on the drill bit 80. The two cone cutter assemblies 89 and 90 form the borehole 20 having the cylindrical sidewall 21, the drill face 22 and the gage corner 23 independently of the rolling cutter wheel 81. The cutting wheel 81 and piston 83 are positioned on the drill bit structure 85 in the position which would otherwise be occupied by a third cone cutter assembly of a conventional offset three-cone bit. The drill bit structure 85 is extended in this area to define the piston chamber 84 and to position the piston member appropriately. Arranged in this manner, the rolling cutter wheel 81 and the cone cutter assemblies 89 and 90 are spaced at one-third circumferential or rotational intervals with respect to one another. The drill bit structure 85 includes a conventional threaded upper end connection, not shown, which serves as means for attaching the drill bit 80 to the drill string at the endmost drill collar 48'. The bit structure also includes conventional wash jet nozzles 91 through which drilling fluid is emitted to wash particle cuttings away from the drill face and gage corner. The particle cuttings and fluid are conducted between the drill string and the cylindrical sidewall out of the borehole.

Rotary drill bits employing only two cone cutter assemblies have proven successful in drilling certain geological formations. By employing the two cone cutter assemblies 89 and 90, the drill bit 80 maintains acceptable drilling rate effectiveness.

The rolling cutter wheel 81 rotates in a plane essentially transverse with respect to the rotational axis of the drill bit. The axis of rotation of the rolling cutter wheel is angled slightly with respect to the rotational axis of the drill bit. The cutting wheel 81 includes an outer circumferential cutting surface 92 formed by conventional cutting elements. The radial outermost point 93 of the circumferential surface 92 is in axial alignment with the gage corner 23 and generally contacts and rides upon the inclined gage corner 23 during drill bit rotation. Upon application of the energy pulse form of the pressurized fluid, the projected piston member 83 forces the cutting surface 92 of the cutting wheel 81 into substantial cutting contact with the gage corner 23. The substantial cutting contact removes additional material from the gage corner as compared to that material removed by normal operation of the conventional cone cutter assemblies 89 and 90. The additional amount of material is removed from the gage corner 23 over the preselected arc of the circumference of the gage corner, and the selected arc corresponds in angular duration to the interval of rotation of the drill string during which the pressure pulse is applied to the piston member 83. After termination of the pressure pulse, the tension spring 87 returns the piston member and cutting wheel 81 to a retracted position out of substantial cutting contact with the gage corner material 23. In the retracted position, no substantial additional material is removed from the gage corner. Thus, the remaining partial arc of the gage corner circumference, being of slightly greater size, applies a slight lateral force to the drill bit. As a result, selective control of the advancement angle of the borehole is achieved.

Abrasion Shoe

Figure 11:
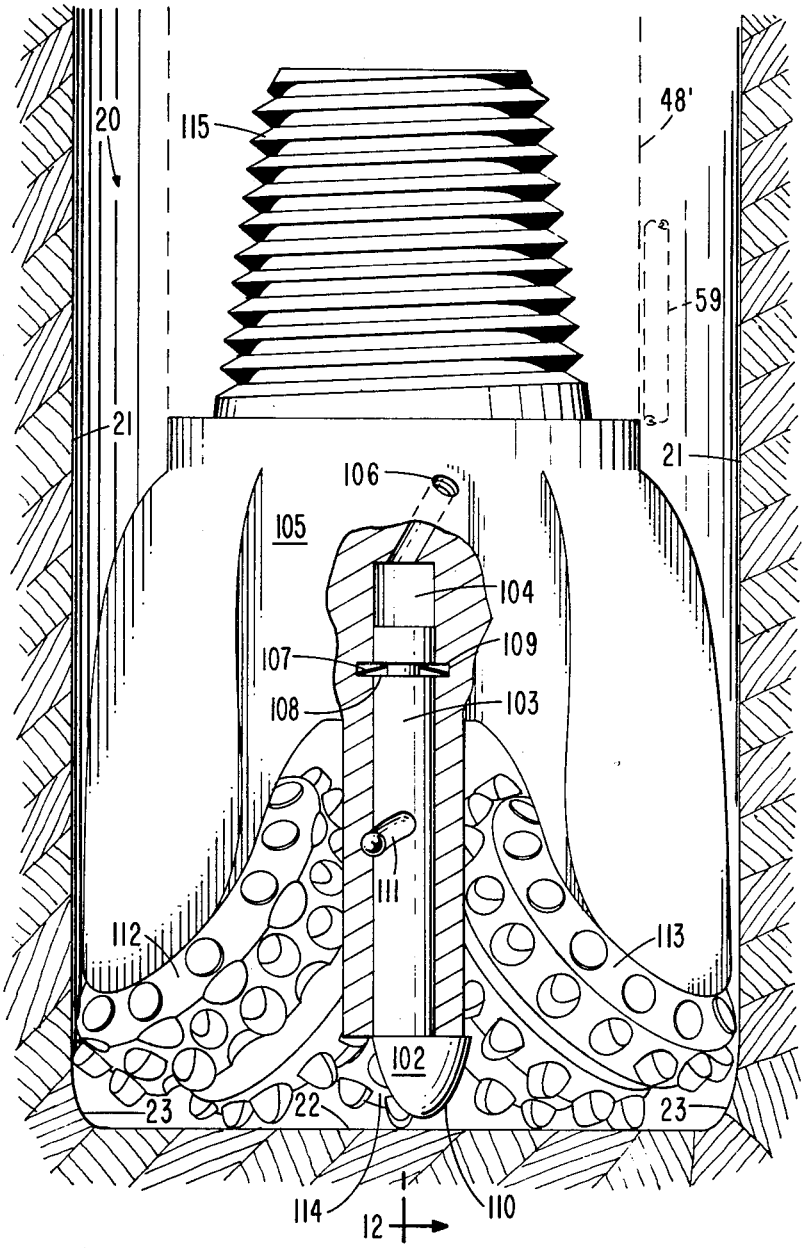
FIG. 11 is a side elevational view of a drill bit with a portion broken away in partial section to illustrate a selectively extendable abrasion show member. The drill bit is shown attached to a drill collar illustrated in phantom, and is positioned in an axially sectioned borehole.
Figure 12:
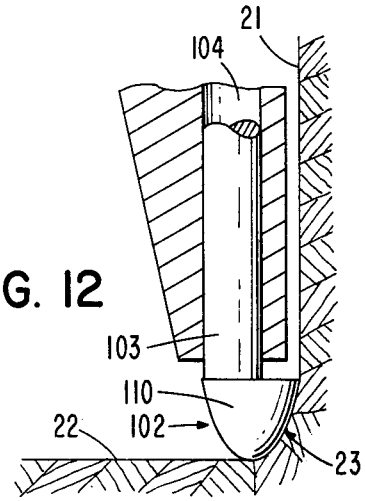
FIG. 12 is a partial sectional view of a portion of FIG. 11 taken in the view plane of line 12 and illustrating an eccentric contour surface of the abrasion shoe member.

A rotary drill bit 100 shown in FIGS. 11 and 12 includes gage corner removal means in the form of a cutter member which is selectively extendable to substantially contact and cut or remove an increased amount of material from the gage corner 23 over the partial selected arc. The cutter member is in the form of an abrasion shoe member 102 attached to or formed as an integral part of a sliding piston member 103 located within a piston receiving chamber 104. The piston receiving chamber 104 is formed in a bit support structure 105 at a predetermined location to position the abrasion shoe member 102 to contact the gage corner 23. Seals, not shown, provide a fluid-tight seal between the piston member 103 and the piston chamber 104. A fluid inlet 106 communicates with the piston chamber 104, and a conventional fitting, not shown, connects the conduit 59 from the hydraulic pump 53 to the inlet 106. A Bellville spring 107 extends between notches 108 and 109 formed respectively in the piston member 103 in the chamber 104. The Bellville spring biases the piston member 103 toward a retracted (upward) position within the chamber 104. Upon application of energy in the form of a pressurized fluid pulse through conduit 59, the pressure within the chamber 104 forces the piston 103 and the attached abrasion shoe 102 to an axially extended (downward) position into substantial cutting contact with the gage corner. The piston member 103 is one form of extendable means for moving to projected and retracted positions and the piston member and chamber 104 form one example of activation means.

The abrasion shoe member 102 includes an abrasion or cutting surface 110 formed at a position adapted to contact the gage corner 23. The abrasion surface 110 is shaped as an offset conical surface as shown best in FIG. 12. The axis of the conical cutting surface 110 is eccentrically spaced in relation to the center axis through piston member 103. A helical ball groove arrangement 111 is connected between the piston chamber 104 and the sliding piston member 103. The ball groove arrangement 111 causes the piston member to rotate slightly upon movement to the projected position. When projected and rotated slightly, the eccentrically shaped abrasion surface 110 is forced into substantial cutting and abrading contact with the gage corner 23. Since the piston receiving chamber 104 must be formed slightly inwardly spaced from the outer circumference or periphery of the drill bit, the eccentrically shaped abrasion surface 110 and the ball groove arrangement 111 bring the cutting surface 110 into cutting alignment with the gage corner.

Three conventional offset cone cutter assemblies 112–114 are positioned on the bit support structure 105. The cutting elements of the cone cutter assemblies 112–114 are arranged to cut the borehole 20 defined by the cylindrical sidewall 21, the drill face 22 and the gage corner 23. A threaded connection 115 is provided on one end of the bit support structure to connect the drill bit 100 to the end of the drill string at the endmost drill collar 48'.

Selective projection of the abrasion shoe member 102 brings the abrasion surface 110 into substantial abrading contact with the gage corner and removes additional amount of material from the gage corner as compared to that amount removed by the cone cutter assemblies 112–114. The application and duration of the pressure pulse from conduit 59 causes the abrasion shoe member 102 to maintain firm cutting contact with the gage corner over the selected arc of the circumference of the gage corner. At the termination of the pressure pulse, the abrasion shoe member is moved to the retracted position, and the abrasion surface 110 does not contact the remaining arc of the gage corner circumference. The interval of drill string and drill bit rotation during which the additional amount of material is removed from the gage corner 23 over the selected arc corresponds in angular duration to the angular duration of the rotational interval during which the pressure pulse is supplied. It is in this manner that the abrasion shoe member 102 removes a different amount of material over the selected arcuate portion of the circumference of the gage corner. The remaining partial arc of the gage corner circumference, not contacted by the abrasion surface and thus of slightly larger size, applies a slight lateral force to the drill bit. As a result, selective control of the advancement angle of the borehole is achieved.

Hinged Drill Bit Connector

Figure 13:
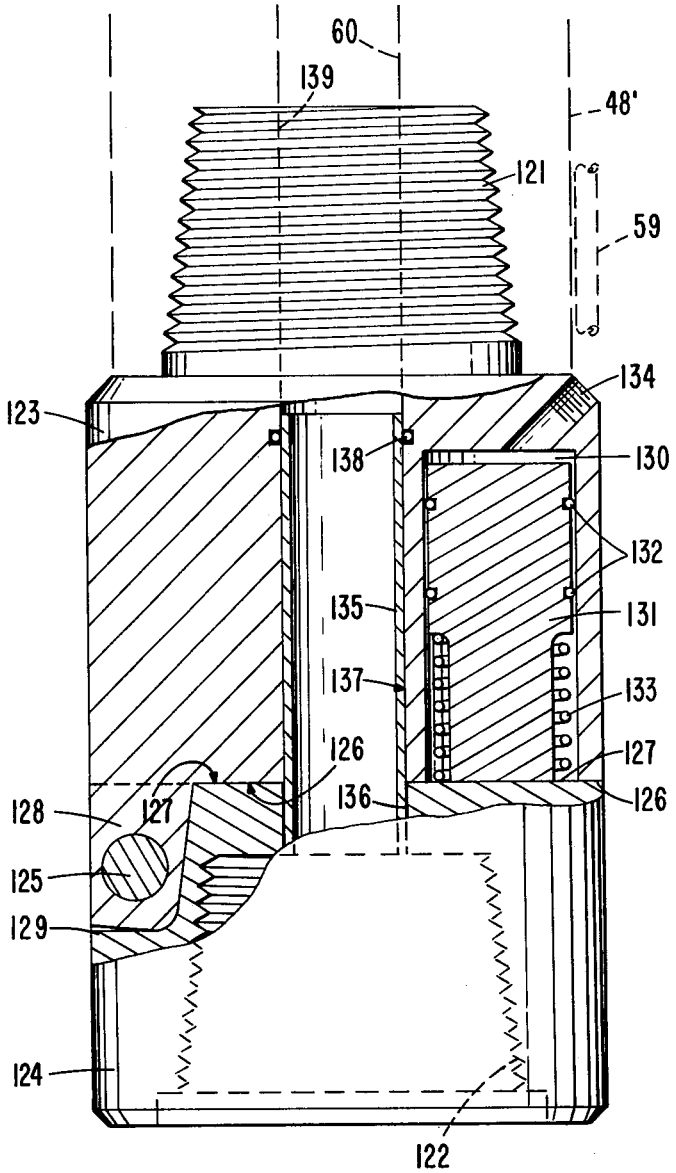
FIG. 13 illustrates a hinged connector apparatus with a portion broken out in an axially extending section to illustrate elements within the apparatus. A drill collar is shown partially and in phantom connected to the connector apparatus.
Figure 14:
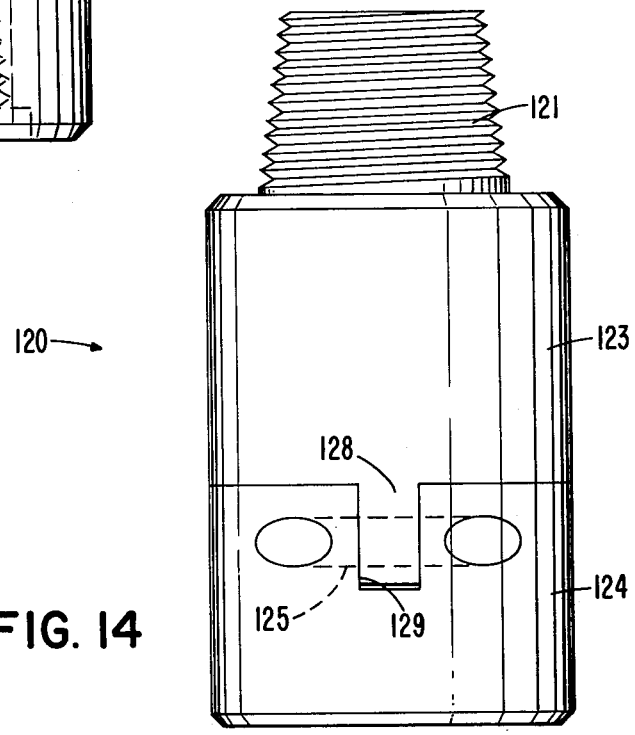
FIG. 14 is a reduced view of the hinged connector apparatus of FIG. 13 rotated 90° counterclockwise with respect to the view of FIG. 13.

A hinged connector apparatus 120 shown in FIGS. 13 and 14, is one form of gage corner removal means arranged for controlling a drill bit to remove a different amount of material over a selected partial arc of the circumference of the gage corner. The connector 120 includes a threaded connection 121 to connect to the end of the drill string at the endmost drill collar 48'. A threaded receptacle 122 is provided for attaching a drill bit, not shown, having cutting elements arranged for cutting the cylindrical sidewall, the drill face, and the gage corner. Typically, it is expected that a conventional offset three-cone drill bit will be utilized in conjunction with the conductor 120.

The hinged connector apparatus 120 comprises an upper body segment 123 which is connected to the end of the drill string at the threaded end 121. The hinged connector 120 also includes a lower body segment 124 which is adapted to be connected to the drill bit at the threaded receptacle 122. A hinge pin 125 hingeably connects the lower body segment 124 to the upper body segment. The hinge pin 125 is positioned at a point radially adjacent the outer periphery of the body segments and radially displaced from the rotational axis of the body segments. The upper body segment includes a transversely extending lower flat surface portion 126 which contacts a corresponding transversely extending upper flat surface portion 127 formed on the lower body segment. With the flat surfaces 126 and 127 in contact, the lower body segment is in axial alignment with the upper body segment, and the center axis of the threaded receptacle 122 is colinear with the axis of the threaded end 121. A downward projecting tab member 128 extends from the flat surface 126 of the upper body segment and is received within a correspondingly shaped receptacle 124 formed into the flat surface 127 of the lower body segment. The hinge pin 125 extends through the projecting tab 128 and the lower body segment 124, as is shown in FIG. 14 to form hinge connection means. Because the projection means 128 fits very closely within the receptacle 129 the projecting tab 128 and receptacle 129 also form means for operatively connecting the upper and lower body segments to resist relative rotation with respect to one another.

At a position preferably diametrically opposite the hinge pin 125, a piston receiving chamber 130 is formed in the upper body segment. The chamber 130 preferably extends in axial direction from the flat surface 126 in an aligned and parallel manner with the center axis of the hinged connector apparatus 120. Received within the chamber 130 is a sliding piston member 131. A fluid tight seal is provided between the chamber 130 and the piston 131 by seal members 132. A compression spring 133 extends between the piston member and the flat surface 127 of the lower body segment 124. The spring 133 biases the piston member to a retracted (upward) position allowing the surfaces 126 and 127 to contact one another. An inlet opening 134 communicates with the piston chamber 130. A conventional connector, not shown, connects the conduit 59 to the inlet opening 134.

Upon application of a fluid pressure pulse, the piston member 131 extends to its projected position and causes the lower body segment to pivot about the hinge pin 125. The piston member is one example of extendable means for selectively pivoting the lower body segment with respect to the upper body segment. The piston 131 and chamber 130 are one form of activation means for activating the piston or extendable means to the projected position.

An axially centered drilling fluid conduit 135 extends between the upper and lower body segments. An opening 136 formed in the lower body segment positions the conduit 135 in alignment with the conventional drilling fluid passage 60 formed in the drill bit. The drilling fluid conduit is brazed or otherwise suitably connected in a fluid-tight manner within the opening 136. An opening 137 in the upper body segment extends axially upward from the flat surface 126 and receives the drilling fluid conduit 135 therein. A seal 138 attaches the conduit 135 in a moveable fluid-tight manner within the opening 137. Since the lower segment pivots only very slightly, the conduit moves and bends only a very slight amount to avoid detrimental effects. An opening 139 extends coaxially from the drilling fluid conduit 135 in a position adapted to be aligned with the drilling fluid passage 60 in the drill collar 48'. Drilling fluid conducted through the center opening 60 of the drill string passes through the hinged connector apparatus 120 into the drill bit even when the lower body segment is pivoted. The drilling fluid is emitted in the conventional manner by the drill bit to remove the particle cuttings from the drill face and gage corner and wash those particles and cuttings from the borehole.

Each pressurized hydraulic pulse forces the piston member 131 to a projected (downward) position against the upper flat surface 127 of the lower body segment and pivots the lower body segment and connected drill bit slightly about the hinge pin 125, clockwise as shown in FIG. 13. The cutting elements of the drill bit vertically below and diametrically opposite the hinge pin 125 are forced into more substantial engaging cutting contact with the gage corner, when the drill bit pivots. Simultaneously, the cutting elements of the drill bit at a point vertically below the hinge pin experience a reduced amount of contact with the gage corner. The hinge point at the hinge pin 125 is positioned axially as close as possible to the drill bit and drill face for the purpose of maximizing the axial component and force applied on the selected partial arc and minimizing the axial component of force applied to the remaining partial arc. Thus, as the drill bit rotates, the pressure pulse forces the cutting elements of the rotary drill bit into more substantial cutting contact with the gage corner material over the selected partial arc of the circumference of the gage corner, and the cutting elements of the drill bit cause a reduced cutting effect on the remaining partial arc of the circumference of the gage corner. In this manner, a greater amount of material is removed over the preselected arc than that amount of material removed over the remaining partial arc of the gage corner.

The different amount of material is removed during the duration of the pressure pulse which extends the piston member and thereby pivots the lower body segment 124. The duration and the beginning and ending points of the pressure pulse are correlated to rotational position to the drill string and drill bit in the manner previously described in conjunction with the control and energy deriving arrangement. The different amount of gage corner material removed over the selected partial arc and during each of a number of drill bit revolutions, creates the resulting slight lateral force to urge the drill bit to a desired and controlled advancement angle.

Pivotable Single Cutter Wheel

Figure 15:
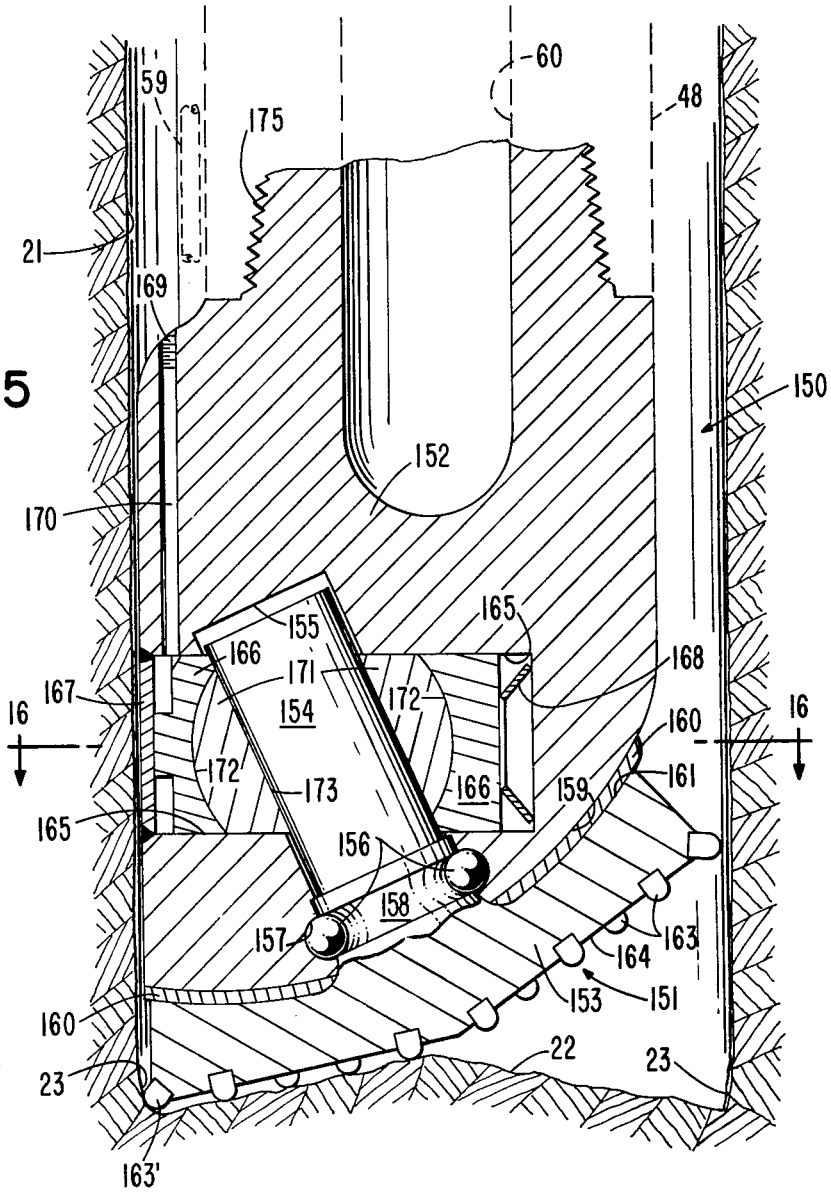
FIG. 15 is an axially extending section view of a drill bit including a pivotable single rolling cutter wheel. The drill bit is shown connected to a drill string illustrated in phantom and inserted in an axially sectioned borehole.
Figure 16:
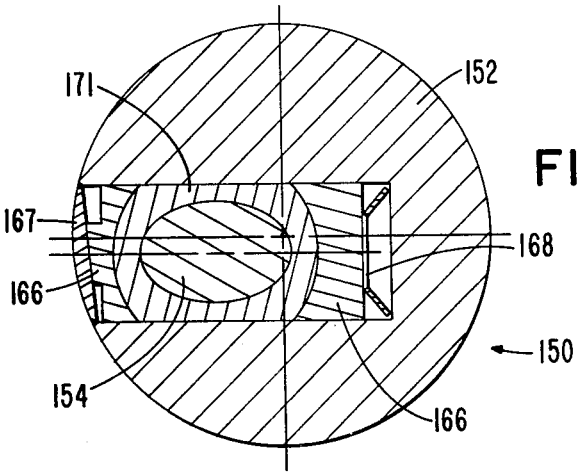
FIG. 16 is a reduced transverse section view of the drill bit taken substantially in the plane of line 16—16 of FIG. 15.

A rotary drill bit 150 shown in FIGS. 15 and 16 includes gage corner removal means in the form of a single cutter wheel member 151 mounted for rotation on a bit support structure 152 and adapted to be pivoted in a manner to remove a different amount of the gage corner material than normally removed. The cutting wheel 151 includes a wheel portion 153 and an axle portion 154 extending normally from the wheel portion. The axle portion 154 is received within an opening 155 formed in the support structure 152. The opening 155 is slightly larger than the diameter of the axle portion 154. A plurality of ball bearings 156 are received within ball bearing races 157 and 158 formed respectively in the axle portion 154 and the bit support structure 152. The ball bearings 156 and races 157 and 158 form one means for rotatably connecting the cutter wheel 151 to the bit structure. The loading opening by which the ball bearings 156 are inserted in the races is not shown.

The lower end 159 of the bit support structure is of a curved shape similar to a portion of a spherical surface. A bearing material inlay 160 is bonded to the curved end portion 159 and finished to a spherical shape. A surface 161 of the wheel portion 153 is of curved shape which corresponds to the spherical shape of the finished bearing material inlay 160. The bearing material inlay and the curved surface 161 contact one another and form bearing surfaces to hold the single cutter wheel 151 in firm engagement with the bit structure during contact with the drill face 22. Wear-resistant cutting elements 163 are attached to a surface 164 of the wheel portion 153 in a manner to contact and cut and remove particles of material from the drill face 22 and gate corner 23.

The bearing surfaces 160 and 161 and the ball bearing assembly 156–158 position the cutter wheel 151 on the drill structure 152 in a predetermined manner. The axle portion 154 extends at an intersecting angle with respect to an axial reference through the rotational center of the bit structure (FIG. 15) and in spaced parallel relation with respect to a radial reference from the rotational center of the bit structure (FIG. 16). The parallel offset radial relation positions the cutter wheel 151 in an offset manner. The offset geometry causes the cutting elements 163 to cut the gage corner 23 in a manner somewhat similarly to the manner in which a conventional cone assembly of an offset three-cone drill bit forms the gage corner. The intersecting angle with respect to the axial reference is selected to achieve desired drilling effects similar to those known in the art and associated with single wheel drilling cutters of the type disclosed in U.S. Pat. No. 2,336,335 to Zublin.

A piston receiving chamber 165 extends radially inward from the outer periphery of the bit support structure 152. A piston member 166 is slidably received within the piston receiving chamber 165. A cover cap 167 is welded or otherwise securely attached in a fluid-tight manner at the outer periphery of the bit support structure to completely cover and enclose the piston chamber 166. A Bellville spring 168 is positioned between the radial innermost ends of the piston member and chamber. The Bellville spring biases the piston member radially outward to a retracted position. A fluid inlet opening 169 and communication channel 170 communicate with the piston chamber. A conventional connector, not shown, connects the conduit 59 to the inlet opening 169. Pressure pulses conducted into the piston chamber 165 cause the piston member 166 to move radially inward a slight amount to a projected position. The piston member forms one example of extendable means for moving between projected and retracted positions. The piston 166 and chamber 165 arrangement form one example of activation means for moving the piston member between the projected and retracted positions.

A spherical bearing 171 is received with a spherical shaped opening 172 formed in the piston member 166. A cylindrical opening 173 extends at an angle through the spherical bearing 171 and receives the axle portion 154 of the cutter wheel. The cylindrical opening 173 closely fits around the axle portion 154 but allows rotation of the axle member relative to the spherical bearing. The exterior surface of the spherical bearing 171 generally coincides with the shape of the inner surface of the chamber 165, although enough clearance for slight pivoting of the bearing 171 in the opening 172 is provided. A threaded end 175 of the support structure forms means for connecting the drill bit 150 to the endmost drill collar 48' of the drill string.

In operation, energy in the form of pressurized fluid pulses is conducted from the hydraulic pump 53 and through the conductor 59, the inlet opening 169 and the channel 170 to the piston chamber 165. The pressurized fluid forces the piston member 165 radially inward to the projected position, and the spherical bearing 171 moves inward with the piston. The spherical bearing applies lateral movement to the axle portion 154 as the piston travels to the projected position, thus pivoting the axle and wheel portions of the cutter wheel 151. The ball bearing assembly 154–156 allows slight pivotable movement of the axle portion 154, and the opening 155 is of sufficient size to allow slight pivotable movement. The piston member thus forms means for pivoting the axle portion to a slightly lesser intersecting angle with respect to the axial reference.

Upon pivoting of the axle portion 174, clockwise as shown in FIG. 15, the cutting elements 163 at the outer periphery of the wheel surface 164 are forced into more substantial engaging and cutting contact with the gage corner 23. Pivoting the cutter wheel forces the lowermost cutting element 163' laterally outward (to the left in FIG. 15) into the material of the gage corner 23. Additional material is removed as compared to that normally removed from the gage corner in the non-pivoted position. Of course, the wheel surface 161 separates slightly from the bearing material inlay surface 160 during pivoting.

Very slight pivotable movement is sufficient to remove enough material from the gage corner such that, over a sufficient number of subsequent revolutions, acceptable control over the advancement angle is achieved. Although not shown, it is typical practice to employ centering stabilizers around the drill string at positions axially displaced from single cutting wheel drill bits 150. The stabilizers hold the bit support structure approximately in centered position in the borehole and the single cutter wheel 151 can be pivoted slightly to achieve the desired effects as a result.

Maintaining the rolling cutter wheel 151 in the pivoted condition during a predetermined interval of drill bit rotation causes an increased amount of material to be removed from the gage corner over the preselected arc. The angular duration of the preselected arc corresponds with the angular duration during which the cutting wheel 151 is pivoted. During the remaining interval of drill bit rotation the cutting wheel returns to its original non-pivoted position, and only a normal amount of material is removed over the remaining arc of the circumference of the gage corner. In this manner, a different amount of material is removed over the preselected arc as compared to the remaining arc of the gage corner. Of course, the duration of the pressure pulse which pivots the rolling cutter wheel is correlated to an interval of drill string and drill bit rotation, and the beginning and ending points of the pressure pulse are correlated to rotational positions of the drill string and drill bit, in the manner previously described in conjunction with the control and energy deriving arrangement. The different amount of gage corner material removed over the selected arc and during a number of drill bit revolutions, creates the resulting slight lateral force to urge the drill bit to a desired and controlled advancement angle.

Fluid Jet

A rotary drill bit 180 shown in FIG. 17 includes gage corner removal means in the form of a fluid jet emitting means for emitting pressurized fluid impinging essentially only on the gage corner 23 of the borehole. The fluid jet emitting means is in the form of a fluid jet emitting nozzle 181 positioned on a drill bit structure 182 to emit the jet therefrom on the gage corner. Three conventional offset cone cutter assemblies 183, 184 and 185 are also connected to the bit support structure 182. The cutting elements of the cone cutter assemblies 183–185 are arranged to cut the borehole 20 defined by the cylindrical sidewall 21, the drill face 22 and the circumferential gage corner 23.

The fluid jet emitting nozzle 181 is received at the lower end of a hollow extension 186 of the bit support structure. The extension 186 extends from the bit support structure intermediate the cone cutter assemblies 183 and 184 at a position normally occupied by one of the three conventional wash jets associated with the conventional offset three-cone drill bit. The extension 186 is terminated at an end point adapted to be adjacent the gage corner 23. A fluid conducting channel 187 is formed in the extension 186 to conduct fluid to the nozzle 181. The nozzle 181 includes an orifice 189 oriented to emit a stream or jet of fluid onto the gage corner in a downward and radial outward direction. An inlet opening 190 communicates with the channel 187. A conventional connector, not shown, connects the conduit 59 from the hydraulic pump 53 to the inlet opening 190. A threaded end connection 191 of the drill bit structure connects the drill bit 180 to the endmost drill collar 48' of the drill string.

Means for selectively conducting pressurized fluid through the fluid jet emitting nozzle 181 takes one form as the hydraulic pump 53 and operatively connected roller member 45. A hydraulic pressurized fluid pulse, preferably taken from the fluid flowing in the center passage 60 of the drill string, is pressurized by the pump 53 and delivered through the conduit 59 to the fluid jet emitting nozzle 181. Receipt of the pressurized fluid activates the jet emitting means by creating the jet impinging on the gage corner. Although not shown in FIG. 6, an opening is formed through the drill collar 48 so that the inlet opening 57 of the pump 53 receives hydraulic fluid only from the drilling fluid passage 60. Referring back to FIG. 17, the pressurized fluid is emitted from the orifice 189 onto the gage corner during the selected interval of drill bit and drill string rotation during which the hydraulic pump 53 is operable. The angular position of the roller member 45 relative to the fluid jet emitting nozzle 181 is determined so that the selected arc upon which the pressurized fluid is emitted is correlated to the angle in which it is desired to advance the drill bit and to the low side portion of the cylindrical sidewall. Thus, the roller member and hydraulic pump arrangement form one example of means for selectively conducting pressurized fluid through the nozzle 181 for a predetermined partial interval of one drill bit rotation and for terminating conduction of the pressurized fluid for the remaining interval of the drill bit rotation.

Two types of effects can be achieved by emitting the pressurized fluid on the gage corner 23. If the emitted fluid is of sufficient pressure to exceed the strength of the earth material 24, the emitted fluid jet will actually cut and remove an amount of material over the gage corner in addition to that removed by the cutting elements of the cone cutter assemblies 183–185. The other effect is that the emitted fluid jet will remove and wash away the particle cuttings more efficiently over the selected arc than the particle cuttings are removed from other areas of the drill face and gage corner by the conventional wash jets of the drill bit 180. By more effectively removing these particles, the cutting elements of the immediately following cone cutter assembly have an increased effect or efficiency in removing slightly additional amounts of gage corner material over the selected arc. In either case, the fluid jet emitted onto the gage corner has the effect of causing a different amount of material to be removed over the selected arc than that normally removed by the cutting elements of the cone cutter assemblies.

Another embodiment of the fluid jet emitting control arrangement is schematically illustrated in FIG. 18. A source of pressurized fluid 192 is positioned on the surface of the earth or at some other location for use with the drilling apparatus. Conduits 193 and 194 conduct the source of pressurized fluid to the fluid jet emitting means or nozzle 181 of the drill bit 180. A selectively controllable valve 195 is positioned between conduits 193 and 194 to open and close the conduit 194 to the source 192 of pressurized fluid. The valve 195 is operated by the energy deriving means 43 positioned at the predetermined position on the drill string 41. As the roller member 45, or some other element of the energy deriving means 43, comes in contact with the low side portion of the sidewall, the valve 195 is activated to one condition, either opened or closed. When the roller member 45 moves out of contact with the sidewall, the valve 195 is activated to the other condition. The valve thus controls the delivery of pressurized fluid over the selected arc. The valve 195 may be electrically or mechanically activated. An example of mechanically activated valve is a conventional valving arrangement which is mechanically moved between an open and a closed condition by activating means such as a piston and cylinder assembly 66.

It is apparent that the fluid jet emitting nozzle 181 causes an effect on the selected arc of the circumference of the gage corner, resulting in removal of a different amount of material over the selected arc than that amount of material removed over the remaining partial arc of the gage corner circumference. Thus, the arrangements described and illustrated in FIGS. 17 and 18 effectively control the advancement angle of the borehole by gage corner removal effects.

Particle Delivery Apparatus

Figure 19:
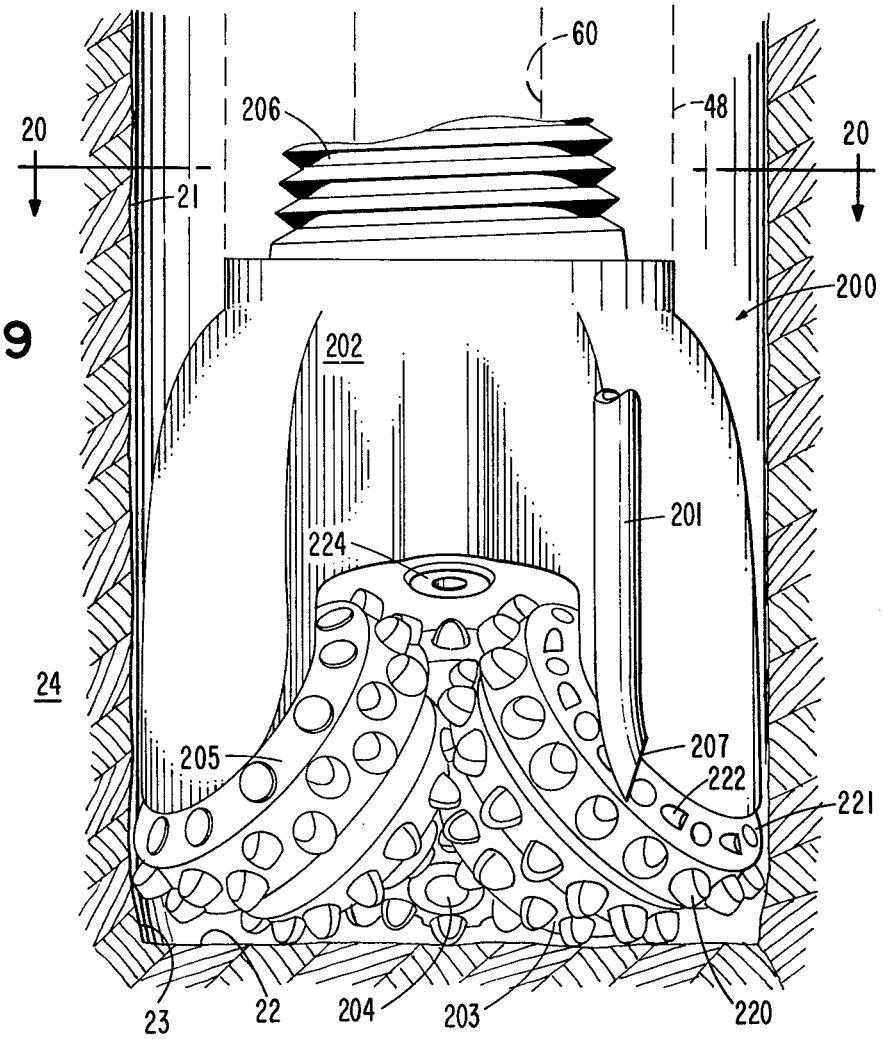
FIG. 19 is a view of a rotary drill bit with which a particle delivery tube is operatively employed. The drill bit is shown connected to a drill collar illustrated in phantom and inserted into an axially sectioned borehole.
Figure 20:
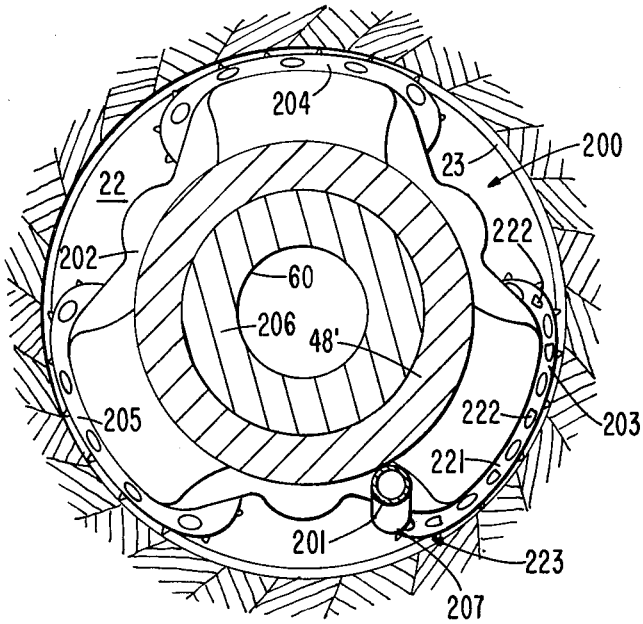
FIG. 20 is a view taken substantially in the plane of line 20—20 of FIG. 19.

A drill bit 200 illustrated in FIGS. 19 and 20 includes gage corner removal means in the form of particle delivery means for selectively delivering hard and drillable particles onto a selected partial arc of the circumference of the gage corner. The particle delivery means takes one form as a particle delivery tube 201 and is attached to a drill bit supporting structure 202. A lowermost open end 207 of the tube 201 is in a position essentially rotationally leading or in advance of one cone cutter assembly 203. Two other cone cutter assemblies 204 and 205 are attached to the bit structure 202, and all three cone cutter assemblies 203–205 are positioned in the conventional offset manner. Consequently, the cutting members of the cone cutter assemblies cut the cylindrical sidewall 21, the drill face 22 and the gage corner 23 during borehole formation. The bit support structure 202 includes a threaded end connection 206 for connecting the drill bit 200 to the endmost drill collar 48' of the drill string.

Figure 21:
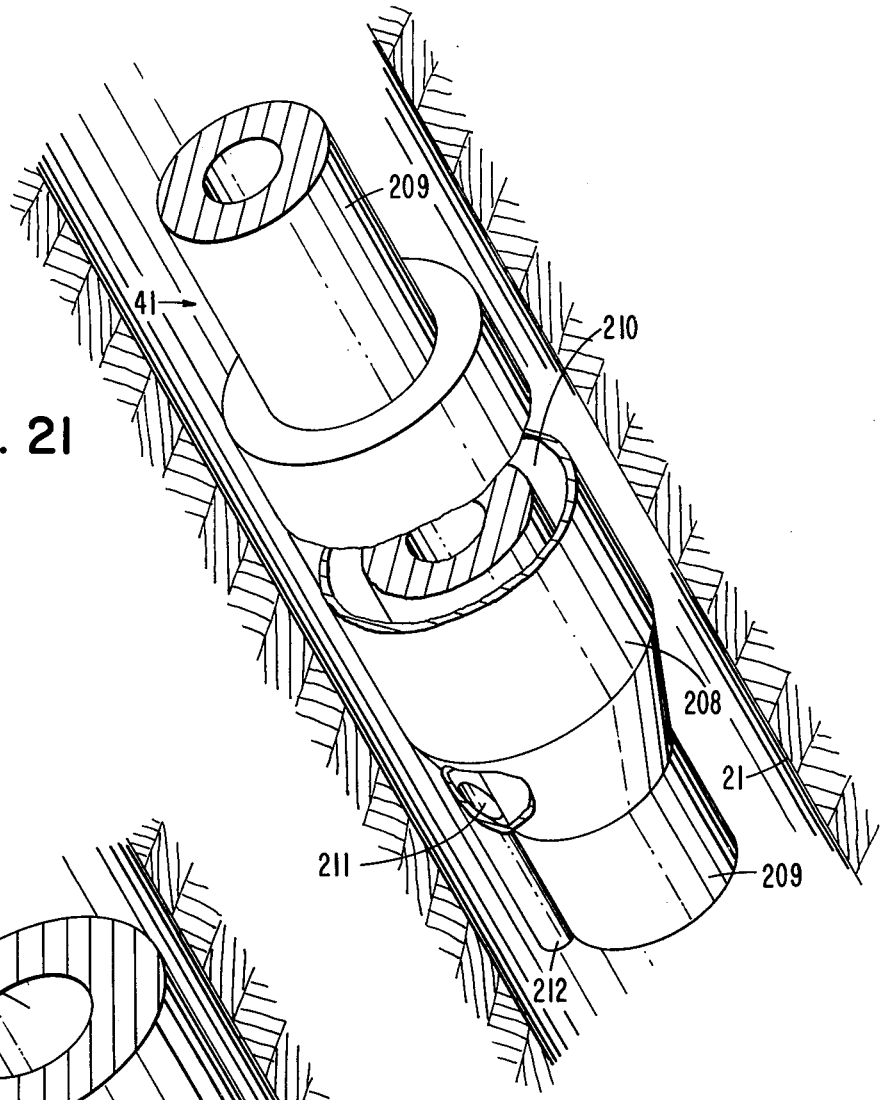
FIG. 21 is a perspective view of a particle hopper attached to a segment of drill collar positioned within an axially sectioned borehole. A portion of the particle hopper and drill collar are broken away to illustrate internal features.
Figure 22:
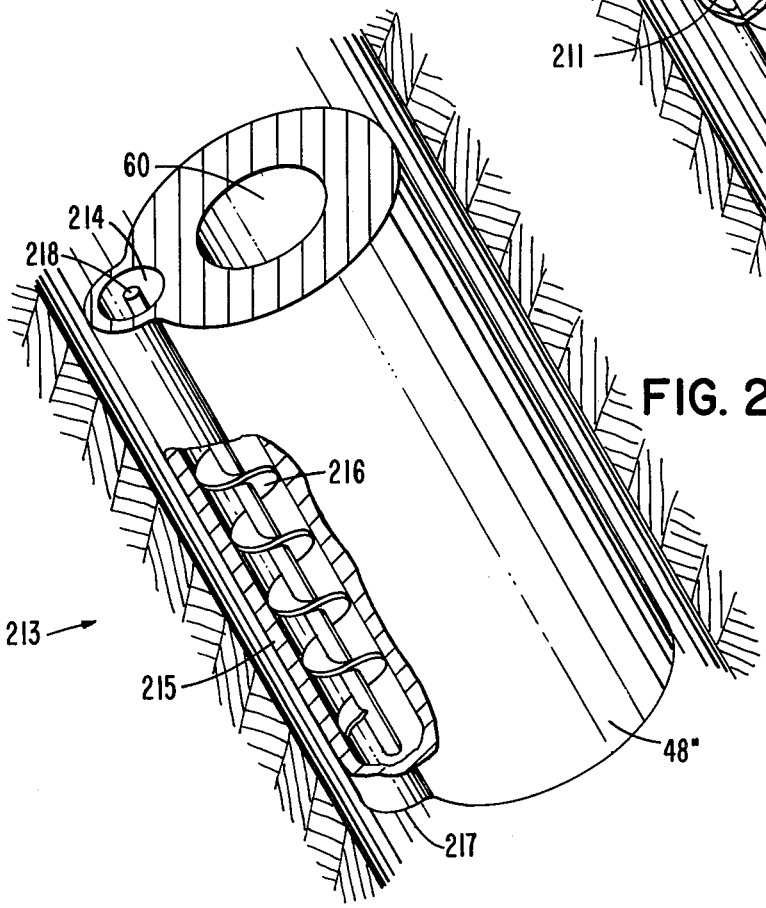
FIG. 22 is an elevational view of an auger assembly, with a portion broken away to illustrate internal elements thereof. The auger assembly is shown attached to a section of drill collar.

The particle delivery tube 201 is connected to a source or supply of hard and drillable particles. One supply is illustrated in FIGS. 21 and 22. Shown in FIG. 21, a particle hopper 208 is connected to a drill collar 209 comprising a portion of the drill string 41. The particle hopper 208 defines a hollow interior 210 between its outer enclosure and the exterior surface of the drill collar 209. An opening, not shown, allows filling the interior 210 of the particle hopper 208 with hard and drillable particles. The particles may be aluminum or plastic material spheres which are loaded into the particle hopper 208 at the surface of the earth before the drill collar 209 is connected into the drill string and inserted into the borehole. A particle discharge outlet 211 opens out of the lower portion of the particle hopper 208 and serves as a means by which the drillable particles are removed from the particle hopper. A conduit 212 extends from the outlet 211 to an auger assembly 213 illustrated in FIG. 22. The auger assembly 213 is positioned on a drill collar 48". The drillable particles are delivered into an upper intake opening 214 of an auger housing 215 from the conduit 212. A screw conveyor 216 rotates within the interior of the housing 215 and forces the drillable particles through the auger assembly and out of a discharge outlet 217. When rotated the screw conveyor 216 applies a considerable amount of force on the drillable particles. The particles are forced out of the outlet 217 through a conduit, not shown, extending to and connecting with the particle delivery tube 201.

A center shaft 218 of the screw conveyor 216 is operatively connected to be rotated by the roller member 45 of the energy deriving means 43 (FIG. 6). The screw conveyor rotates only during the interval of drill string rotation in which the roller member 45 contacts and rolls against the low side portion 51 of the sidewall 21. Thus, the particles are forced from the outlet 217 of the auger assembly 213 and into the particle delivery tube 201 only during the partial interval of drill string rotation. The apparatus for forcing or delivering the particles from the particle delivery tube forms is an example of activation means for activating the particle delivery means.

Figure 23:
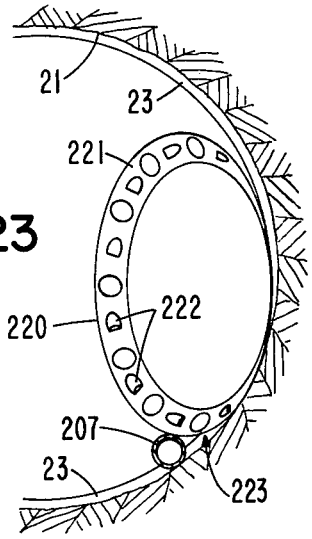
FIGS. 23 and 24 are schematic illustrations, respectively in top and side section views, of elements of the drill bit shown in FIGS. 19 and 20 and of the characteristics of the borehole.
Figure 24:
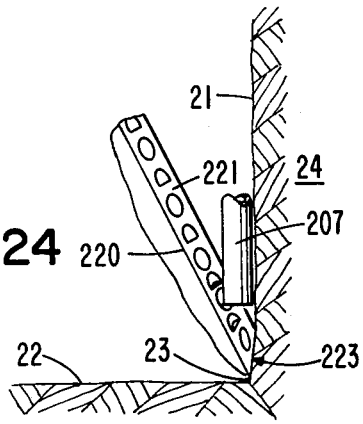

The drillable particles are forced out of the outlet end 207 of the particle delivery tube 201 onto the gage corner at a position 223 slightly rotationally in advance of an outermost cutter wheel member 220 of the cone cutter assembly 203, as is shown in FIGS. 19, 20, 23 and 24. An outer conical gage surface 221 of the cutter wheel 220 cuts the gage corner 23 and outer cylindrical sidewall 21. Wedge shaped depressions 222 are formed in the surface 221. The blunt ends of the wedge shaped depressions 222 come in contact with the gage corner prior to the time that the pointed or narrow ends of the depressions 222 contact the gage corner. The blunt ends of the depressions 222 extend into the surface 221 to a greater depth than the pointed or trailing ends. As seen in FIGS. 23 and 24, the drillable particles are delivered into the converging space 223 formed by the conical gage surface 221 of the cutter wheel 220 rotating into contact with the gage corner 23. The depressions 222 carry the drillable particles into the converging space 223.

Various effects occur as the particles are drawn into a crusher-like relationship between the surface 221 and the gage corner 23. The drillable particles are cut and crushed by the cutter wheel 220, and the cutting wheel 220 is less effective in cutting additional material 24 from the gage corner 23, as compared to the cutting effect achieved by normal operation of cone cutter assemblies 204 and 205. The particle cuttings of material 24 previously removed from the drill face are less efficiently removed or washed away over the predetermined arc because additional drillable particles are delivered. The drillable particles drawn into the converging space 223 create a crusher-like relationship between the surface 221 and the gage corner 23, and this crusher-like relationship applies lateral force on the bit over the selected arc of the gage corner. The total effect is less effective removal of material over the selected arc of the gage corner than over the remaining partial arc. The more inhibited removal of gage corner material leaves a slightly larger gage corner over the selected arc and the drill bit is forced away from the selected arc toward the direction of the remaining partial arc of the gage circumference.

Operation of the screw conveyor 216 shown in FIG. 22 creates sufficient force on the drillable particles to force them out of the lowermost end 207 of the particle delivery tube 201. The force overcomes the pressure of the drilling fluid at the drill face resulting from operation of the conventional washing jets 224 (FIG. 19) of the drill bit 200. A conventional check valve, not shown, can be employed adjacent the lowermost end of the particle delivery tube 201 to prevent the particles from settling out of the tube during intervals of drill string rotation when the screw conveyor or other suitable forcing means is inoperative.

Another embodiment of the gage corner removal-particle delivery means eliminates the necessity for the particle hopper 208. Instead of employing the particle hopper the auger housing extends a considerable axial distance along the exterior of the drill string. Once filled with the drillable particles, the auger housing serves as a reservoir or source of particles. Of course, the auger assembly still employs means for forcing the particles out of the particle delivery tube. With either an elongated screw conveyor housing or a particle hopper, the supply of drillable particles must be periodically replenished, and to do so requires removal of the drill string from the borehole to gain access to the particle storage supply enclosures or containers.

Figure 25:
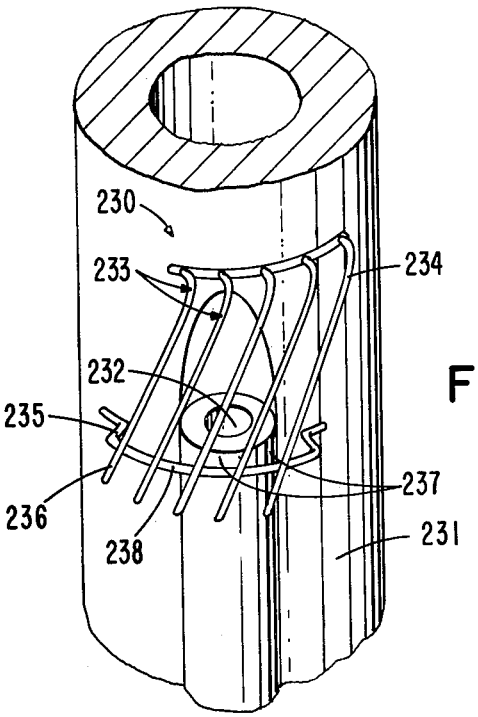
FIG. 25 is a perspective view of a deflecting means attached to the exterior surface of the drill collar and associated with the auger assembly illustrated in FIG. 22 or with the control and energy deriving means illustrated in FIG. 5.

A deflecting means 230 illustrated in FIG. 25 avoids the necessity for periodically replenishing a specific supply of drillable particles. The deflecting means 230 obtains or deflects hard drillable particles from the typical outflow of drilling fluid and particle cuttings flowing out of the borehole between the drill string and the cylindrical sidewall. The deflecting means deflects a preselected size of particle cuttings from the outflow of fluid and particles and makes the deflected particles available for delivery to the particle delivery means.

The deflecting means 230 is attached to a drill collar 231 and extends over an intake opening 232 such as the intake 214 to the auger assembly 215 shown in FIG. 22 or the intake 57 of the hydraulic pump 53 shown in FIG. 6. The particle cuttings of preselected size are conducted into the inlet opening 232, and those particles of other sizes continue upward from the borehole in the outflow of drilling fluid and particle cuttings. The deflecting means comprises a plurality of J-shaped and parallel spaced apart screen bars 233. The curved end 234 of each bar 233 is attached to the drill collar above and curves inward toward the intake opening 232. A U-shaped bar 235 is connected to the exterior surface of the drill collar and extends transversely of the drill collar. The bar 235 supports the straight ends 236 of the J-shaped bars 233 at a position radially spaced from the drill collar 231. The U-shaped bar 235 defines an inlet opening 237 of size defined by the radial space between the circumferential extending and radially outward spaced portion 238 of the bar 235 and the exterior surface of the drill string. The space between the parallel J-shaped bars is less than the radial width of the intake opening 237. The J-shaped bars extend or angle generally longitudinally along the drill collar 231 in the direction in which the drill string rotates. By angling toward the direction of drill string rotation, the J-shaped bars 233 and the intake opening 237 rotate into the outflow of fluid and particles and collect the particle cuttings more effectively.

Large particles encountered by the deflecting means 230 will not pass through the intake opening 237 and these large particles are deflected away from the deflecting means 230. Particles which are smaller than the intake opening 237 flow into the deflecting means. The particles which are small enough to escape between the spaced-apart J-shaped bars continue upward with the outflow of fluid and particle cuttings. Particles which are too large to escape through the spaced-apart J-shaped bars are directed by the curved ends 234 into the intake opening 232. The size of the particle cuttings supplied to the intake opening 232 is selected to be greater than the average size of the cuttings removed from the drill face by the cutting elements of the drill bit. These coarser than average particle cuttings, when delivered to the gage corner, have an increased inhibiting effect since they are larger than those present as a result of normal drill bit operation.

When the deflecting means 230 is operatively associated with the auger assembly 213 (FIG. 22) the particles collected at the intake opening 232 are drawn into the screw conveyor housing and delivered to the gage corner by rotation of the screw conveyor, in the manner previously described. A supply of drillable particles is obtained from the continuously available source of particle cuttings removed by the drill bit and these particle cuttings are delivered to the gage corner to achieve the desired angle control effects.

Figure 26:
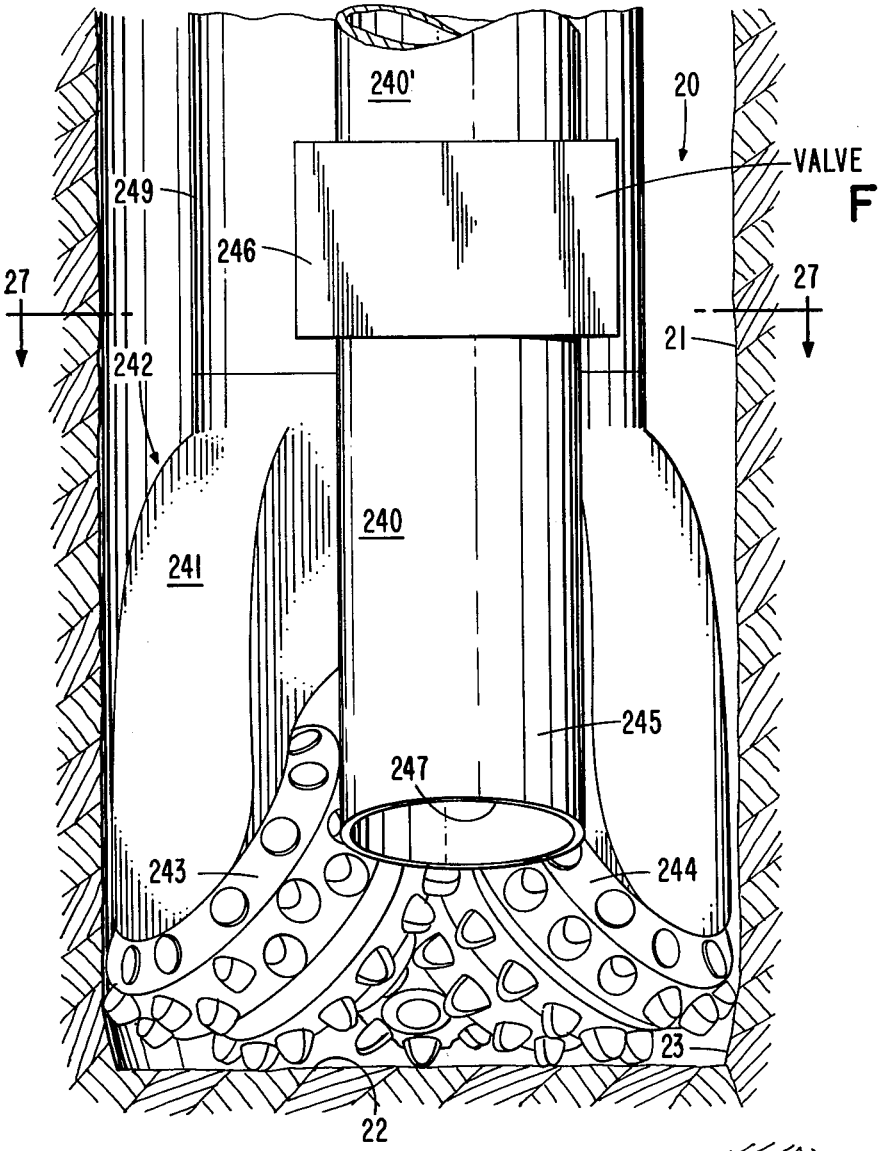
FIG. 26 is an elevational view of a drill bit with which a particle flow tube is associated. The drill bit is illustrated connected to a drill collar and the flow tube is illustrated connected to a valve means represented schematically. The drill bit is shown inserted in an axially sectioned borehole.
Figure 27:
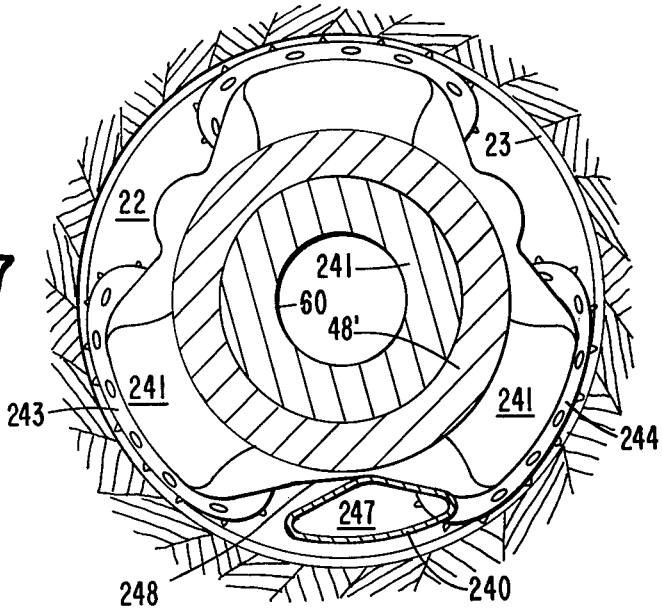
FIG. 27 is a view taken substantially in the plane of line 27—27 of FIG. 26.

Another gage corner removal-particle delivery means for delivering particles to the gage corner is illustrated in FIGS. 26 and 27. A particle delivery or flow tube 240 is attached to the exterior surface of a bit support structure 241 of a conventional offset three-cone drill bit 242. The flow tube is hollow with a relatively large interior opening 247. The flow tube 240 is positioned generally intermediate two cone cutter assemblies 243 and 244, preferably in an indention 248 formed in the bit structure at the position normally occupied by one wash jet. Alternatively the flow tube is attached to the bit structure 241 adjacent one of the conventional fluid wash jets. A bottom end 245 of the flow tube 240 is located generally in a position adapted to be adjacent to the gage corner 23. The flow tube 240 extends axially upward from the bottom end 245 to valve means schematically illustrated at 246 positioned adjacent a drill collar 249. An extension 240' extends upward a short distance from the valve means 246. The valve means 246 is operable to selectively restrict or close the normally open interior of the flow tube 240. The valve means 246 includes a conventional valve, not shown, which is opened and closed by activation means such as a piston and cylinder assembly 66 or electrical solenoid 69, previously described.

During normal drill bit operation, the conventional wash jets, not shown, associated with the drill bit 242 wash the particle cuttings removed by the drill bit from the drill face and gage corner and conduct them upwardly in an outflow between the drill string and the cylindrical sidewall. The outflow completely surrounds the drill bit and drill string and a portion of the outflow flows upwardly through the normally open and relatively large interior opening 247 of the flow tube 240.

The valve means 246 is actuated by the energy deriving means 43 previously described. During the duration of the energy pulse delivered from the energy deriving means 43, the valve means 246 closes the normally open interior flow tube 240. The flow tube is thereby restricted during a selected interval of drill bit rotation. During this interval of rotation, the normal flow of fluid and particle cuttings upward through the flow tube terminates. The velocity of the particle cuttings drops to zero and the particle cuttings settle downward through the flow tube according to Stokes Law. The settling particle cuttings are deposited from the open bottom end 245 essentially on the gage corner region 23 of the borehole. The valve means 246 operatively delivers particles from the particle flow tube 240 and this is one example of activation means for activating the particle delivery means.

The settled particle cuttings create two effects at the gage corner, with the ultimate result being that a different amount of material is removed over a partial selected arc of the circumference of the gage corner than over the remaining partial arc of the gage corner circumference. One effect is that the settled particle cuttings inhibit or reduce the cutting effectiveness of the cone cutter assembly 244 rotationally trailing the flow tube. The cutter assembly is less effective in removing additional material 24 from the gage corner 23 because the additional delivered particles must also be cut. Thus a slightly excessive amount of material is left or remains at the gage corner over one selected arc. The second effect is that the reduced upward flow velocity in the region of the end 245 of the closed flow tube causes a greater flow of fluid and particle cuttings in the regions intermediate the other cone cutter assemblies. The higher fluid flow in the other regions more effectively removes the particle cuttings from the gage corner in those regions. The cone assemblies become more effective with increased particle removal and remove an increased amount of material over the remaining arc of the gage corner circumference. At the end of the predetermined interval of rotation during which the valve means 246 is closed, the energy pulse terminates and the valve means opens to allow normal flow of particles and drilling fluid through the flow tube away from the drill face and gage corner.

Since a different amount of material is removed over one partial arc of the circumference of the gage corner than that material over the remaining partial arc of the gage corner circumference, the larger or more inclined gage corner are forces the drill bit in a radial direction toward the partial arc over which a greater amount of gage corner material has been removed.

Figure 28:
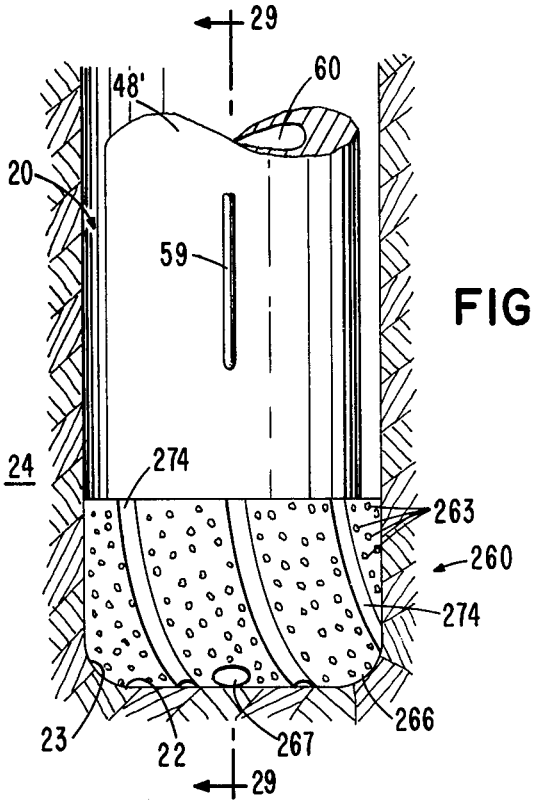
FIG. 28 is a side elevational view of a diamond type non-rolling drill bit with which a particle delivery tube is operatively employed. The drill bit is shown connected to a drill collar and inserted into an axially sectioned borehole.
Figure 29:
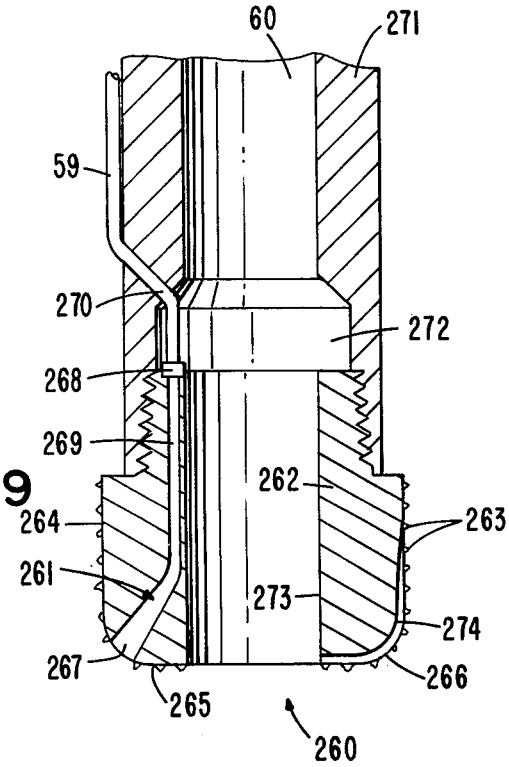
FIG. 29 is a view taken substantially in the plane of line 29—29 of FIG. 28.

A drill bit 260 illustrated in FIGS. 28 and 29 includes gage corner removal means in the form of a particle delivery tube 261. The drill bit 260 is of the non-rolling cutter type having a bit support structure 262 defining a cutting surface to which cutting elements such as diamond insets 263 are attached. The cutting surface includes an axially extending cylindrical sidewall cutting portion 264, a transversely extending drill face cutting portion 265, and a substantially rounded corner cutting portion 266 which curves at a radius between the sidewall and drill face portions 264 and 265 respectvely. The diamond insets 263 are firmly attached to the cutting surface portions 264–266 in a pre-determined pattern. Upon rotation of the drill bit in contact with the earth material, the diamond insets on the cutting portions 264–266 respectively cut and define the cylindrical sidewall 21, the drill face 22 and the gage corner 23. The substantial curvature of the corner cutting surface portion 266 defines the substantial gage corner 23 angling radially outward at inclination from the drill face to the sidewall.

The particle discharge tube 261 is drilled or otherwise formed in the bit structure 262. A discharge opening 267 of the particle delivery tube 261 opens directly into a point on the curved corner cutting portion 266. A conventional connector 268 connects the other end or inlet 269 of the particle delivery tube 261 to the conduit 59. The conduit 59 extends through an appropriately formed opening 270 in the endmost drill collar 271 connected to the drill bit 260. The conduit 59 is sealed within the opening 270 in a fluid tight manner to prevent the escape of drilling fluid from the drilling fluid passage 60 in the center of the drill string. An enlarged annular pocket 272 is formed in the drill collar 271 axially adjacent the drill bit to allow the conduit 59 to be connected to the inlet and 269 of the particle delivery tube.

A cylindrical center opening 273 is formed through the bit support structure 262 in axial alignment with the passage 60 in the drill string and drill collar 271. Drilling fluid circulates downward through the openings 60 and 273 and flows radially outward along the cutting surface portions 265, 266 and 264. Grooves 274 formed inwardly in the cutting surfaces 264–266 of the bit 260 aid distribution of the drilling fluid over the surfaces 264–266.

Typically, the bit 260 will be used to obtain a core sample of earth material 24. The cores sample is cut by the rotating drill bit, leaving a center core of material to extend upward through the center opening 273 and into the opening 60 of the drill string. The diameter of the core sample is slightly less than the interior diameter of the openings 273 and 60, and drilling fluid flows around the exterior of the core sample to the drill face and cutting surfaces of the bit.

To control the angle taken by the bit 260, hard and drillable particles are supplied through the conduit 59 and forced from the discharge opening 267 of the particle delivery tube 261. The drillable particles are deposited on the gage corner 23 of the bore hole and effectively inhibit normal cutting effects of the diamond insets 263 at the curved corner cutting portion 266 over a predetermined arc of the gage corner. As a result, a slightly larger amount of gage corner material remains as compared to that which would normally have been removed by operation of the drill bit. The drillable particles are delivered only during a predetermined partial revolution of the drill bit, and are thereby effective only over a corresponding predetermined and selected partial arc of the circumference of the gage corner 23. The remaining partial arc of the gage corner circumference is cut to a normal level. The selected partial arc of the gage corner circumference is of slightly larger size that the remaining arc and thereby applies a slight lateral force on the drill bit to control its advancement angle. The supply of hard and drillable particles is obtained from one of the arrangements previously described.

From the foregoing description, it is apparent that effective angle changes can be achieved by very small removals of different amounts of material over a selected partial arc of the gage corner circumference, as compared to the material removed from the remaining partial arc of the circumference. Furthermore, the gage corner removal means for removing the different amount of material cooperate with known rotary drill bits to achieve a normal and acceptable rate of drilling penetration as the advancement angle of the borehole is changed or controlled. The control and energy deriving apparatus operates reliably and consistently as an inherent result of drill string rotation. Furthermore, the control and energy deriving apparatus operates in predetermined correlated relationship with a stationary reference, the low side portion of the sidewall, and controls the drill bit relative to the stationary reference to achieve consistent gage corner removal effects from one revolution of the drill bit to the next. It is apparent, therefore, that the present invention significantly advances the development of the art relative to controlling the advancement angles of boreholes cut by rotary drill bits.

Preferred embodiments of the present invention have thus been described with a degree of particularity. It should be understood, however, that the specificity of the present disclosure has been made by way of example, and that changes in details of features may be made without departing from the spirit of the invention.

I claim as my invention:

1. A method of controlling the angle of advancement of a borehole formed in material by a rotary drill bit having cutting elements for cutting the material and defining an axially extending cylindrical sidewall of the borehole, a drill face of the borehole extending essentially transversely with respect to the sidewall and a gage corner of the borehole extending circumferentially from the drill face radially outward at an inclination to the cylindrical sidewall comprising operations of:

continuously rotating said drill bit with the cutting elements in contact with the material, and simultaneously during at least one complete drill bit revolution removing a different amount of material over a preselected partial arc of the circumference of the gage corner than the amount of material removed over the remaining partial arc of the circumference of the gage corner, and controlling the borehole advancement angle predominantly by interacting cutting elements of said drill bit with the material defining the whole gage corner circumference.

2. A method of controlling the angle of advancement of a borehole formed in material by a rotary drill bit having cutting elements for cutting the material and defining an axially extending cylindrical sidewall of the borehole, a drill face of the borehole extending essentially transversely with respect to the sidewall, and a gage corner of the borehole extending circumferentially from the drill face radially outward at an inclination to the cylindrical sidewall, and wherein a drill string extends into the borehole and is connected at one end to the drill bit, comprising operations of:

continuously rotating the drill string and the drill bit connected thereto with the cutting elements of the drill bit in contact with the material defining the drill face and the gage corner, p1 predetermining a position on the drill string axially displaced from the drill bit at which gravity induced sag causes the drill string to contact the low side portion of the cylindrical sidewall during rotation of the drill string, fixing driver means at the predetermined position on the drill string to operatively contact a low side portion of the cylindrical sidewall during a partial interval of rotation of the drill string and to further avoid contact with the cylindrical sidewall during the remaining other interval of the same rotation of the drill string, whereby the driver means contacts the low side portion of the sidewall in periodic intervals determined by rotation of the drill string, arranging the driver means for deriving energy from movement relative to the cylindrical sidewall during the intervals of contact with the cylindrical sidewall, utilizing at least part of the energy derived by said driver means in removing a different amount of material from the gage corner over a preselected partial arc of the circumference of the gage corner than the amount of material removed over the remaining partial arc of the circumference of the gage corner during one revolution of said drill bit, and controlling the borehole advancement angle predominantly by interfacing cutting elements of said drill bit with the material defining the whole gage corner circumference.

3. A method as defined in claim 2 wherein:

the driver means is arranged to derive energy pulses of duration related to the interval of contact of the driver means with the cylindrical sidewall, and the energy pulses are utilized in removing the different amount of material from the gage corner only over the duration of the interval of the energy pulses.

4. A method of changing the angle of advancement of a borehole from an established course, said borehole being formed in material by a rotary drill bit having cutting elements for cutting the material and defining an axially extending cylindrical sidewall of the borehole, a drill face of the borehole extending essentially transversely with respect to the sidewall and a gage corner of the borehole extending circumferentially from the drill face radially outward at an inclination to the cylindrical sidewall, said angle change method comprising operations of:

continuously rotating said drill bit with the cutting elements in contact with the material, and simultaneously during each of a plurality of complete drill bit revolutions removing a different amount of material over a preselected partial arc of the circumference of the gage corner during a partial interval of one drill bit revolution than the amount of material removed over the remaining partial arc of the circumference of the gage corner during the remaining interval of the one drill bit revolution, and initiating lateral force on the drill bit to change the advancement angle substantially only from directly interacting the cutting elements with the material defining the whole gage corner circumference.

5. A method as defined in claims 1, 3 or 4 wherein the cutting elements of said drill bit comprise cutter wheels rotationally attached to said drill bit.

6. A method of controlling the angle of advancement of a borehole formed in material by a rotary drill bit having rotating cutting wheels for cutting the material and defining an axially extending cylindrical sidewall of the borehole, a drill face of the borehole extending essentially transversely with respect to the sidewall, and a gage corner of the borehole extending circumferentially from the drill face radially outward at an inclination to the clylindrical sidewall, and wherein a drill string extends into the borehole and is connected at one end to the drill bit, comprising operations of:

continuously rotating the drill string and the drill bit connected thereto with the cutting wheels of the drill bit in contact with the material defining the drill face and the gage corner, predetermining a position on the drill string axially displaced from the drill bit at which gravity induced sag causes the drill string to contact the low side portion of the cylindrical sidewall during rotation of the drill string, fixing driver means at the predetermined position on the drill string to operatively contact a low side portion of the cylindrical sidewall during a partial interval of rotation of the drill string and to further avoid contact with the cylindrical sidewall during the remaining other interval of the same rotation of the drill string, whereby the driver means contacts the low side portion of the sidewall in periodic intervals determined by rotation of the drill string, arranging the driver means for deriving energy from movement relative to the cylindrical sidewall during the intervals of contact with the cylindrical sidewall, utilizing at least a part of the energy derived by said driver means in removing a different amount of material from the gage corner over a preselected partial arc of the circumference of the gage corner than the amount of material removed over the remaining partial arc of the circumference of the gage corner during complete ones of a plurality of revolutions of said drill bit, and transmitting control force to said drill bit to control the advancement angle substantially only from directly interacting the cutting wheels with the material defining the whole gage corner circumference.

7. A method as defined in claims 1, 3, 4 or 6 wherein the preselected arc is positioned with respect to the axial center of the borehole in the radial direction in which the borehole is angled.

8. A method as defined in claim 7 wherein the different amount of material is removed over the preselected arc during each of a plurality of consecutive revolutions of said drill bit.

9. A method as defined in claims 1, 3, 4 or 6 wherein the operation of removing a different amount of material over the preselected arc comprises the operation of:

removing material over only the preselected arc in addition to that removed over the remaining arc by normal operation of the cutting elements of said drill bit.

10. A method as defined in claim 9 comprising the further operation of:

connecting on said drill bit additional cutter means selectively operable when activated for removing the additional material from the gage corner, and activating said additional cutter means during a selected interval of one rotation of said drill bit, the selected interval of rotation corresponding in angular duration to the preselected arc.

11. A method as defined in claims 1, 3, 4 or 6 wherein the operation of removing a different amount of material over the preselected arc comprises the operations of: p1 allowing normal removal of material from the gage corner over the preselected arc by the cutting elements of the drill bit and simultaneously, inhibiting normal removal of material from the gage corner by the cutting elements of said drill bit over the remaining partial arc.

12. A method as defined in claim 11 wherein the operation of inhibiting normal removal of the material from the gage corner comprises the further operation of:

delivering additional drillable material to the gage corner over the remaining arc, whereby the cutting elements of the drill bit cut the additional drillable material during passage over the remaining arc and the cutting elements of the drill bit normally cut the gage corner material over the preselected arc.

13. A method as defined in claim 6 further comprising:

maintaining said drill string adjacent said drill bit substantially free of lateral forces induced by said drill string influencing lateral movement of said drill bit.

14. A method of controlling a drilling operation of drilling apparatus wherein a rotary drill bit is connected to an axially extending drill string and the drill string is rotated to cut an axially extending borehole defined in part by an axially extending cylindrical sidewall, comprising operations of:

continuously rotating the drill string and connected drill bit, predetermining a position on said drill string axially displaced from the connected drill bit at which gravity induced sag causes the drill string to contact a low side portion of the cylindrical sidewall of the borehole continuously during rotation of said drill string, fixing a roller member at the predetermined position on the drill string to operatively contact and roll against an arcuate portion of the low side portion of the cylindrical sidewall during an interval of rotation of the drill string and to further avoid contact with the sidewall during the remaining other interval of rotation of the drill string, whereby said roller member contacts and rolls against the low side portion of the sidewall in periodic intervals determined by the rotation of the drill string, deriving energy from rotational movement of said roller member with respect to said drill string when in contact with and rolling against the low side portion of the sidewall, and utilizing the energy derived to control a drilling operation of the drilling apparatus.

15. A method as defined in claim 7 wherein: the energy derived is a pulse of energy during the interval of contact with the sidewall, and the pulse of energy is utilized by said drilling apparatus during the interval of rotation of said drill bit, the interval of use by said drilling apparatus approximately corresponding to the interval of contact of said driver means with the sidewall of the borehole.

16. A method as defined in claim 8 wherein: the drilling operation of the drilling apparatus which is controlled is the angle of advancement of said drill bit, and the energy derived is utilized to control the angle at which the drill bit cuts.

17. A method as defined in claim 15 further comprising operations of:

providing energy generator means operative when rotated to generate energy, and operatively connecting said energy generator means to be rotated by rotation of said roller member.

18. Apparatus for controlling the angle of advancement of a borehole in material, comprising in combination:

a rotary drill bit adapted for cutting a borehole defined in the material by an axially extending cylindrical sidewall, a drill face extending essentially transversely with respect to the cylindrical sidewall, and a gage corner extending circumferentially from the drill face radially outward at an inclination to the cylindrical sidewall;

a drill string adapted to be rotated and to extend generally axially into the borehole;

means for connecting said drill bit to an end of the drill string;

means for rotating said drill string and said connected drill bit with said drill bit in contact with the drill face and gage corner of said borehole;

energy deriving means positioned on the drill string at a predetermined position axially displaced from said drill bit, the predetermined position being one position at which gravity induced sag causes said energy deriving means to contact the low side portion of the cylindrical sidewall during an interval of each revolution of said drill string, said energy deriving means operable for deriving energy from movement of said drill string relative to the cylindrical sidewall when in contact with the low side portion of the cylindrical sidewall;

gage corner removal means connected in operative association with the cutting elements on said drill bit and selectively operable when activated for removing a different amount of material from the gage corner over a selected partial arc of the circumference of the gage corner than the amount of material removed by said drill bit over the remaining partial arc of the circumference of the gage corner during one complete revolution of said drill bit, and means connected to said gage corner removal means for operatively receiving energy derived from said energy deriving means and for activating said gage corner removal means without operatively transmitting substantial lateral force through said connecting means.

19. Apparatus as defined in claim 10 wherein:

the predetermined position on said drill string also being one at which gravity induced sag causes said drill string to continuously contact the low side portion of the sidewall during rotation, and said energy deriving means is attached at the exterior surface of said drill string.

20. Apparatus for controlling the angle of advancement of a borehole in material, comprising in combination:

a rotary drill bit adapted for cutting a borehole defined in the material by an axially extending cylindrical sidewall, a drill face extending essentially transversely with respect to the cylindrical sidewall, and a gage corner extending circumferentially from the drill face radially outward at an inclination to the cylindrical sidewall;

a drill string adapted to be rotated and to extend generally axially into the borehole;

means for connecting said drill bit to an end of the drill string to rotate with the drill string within the borehole;

gage corner removal means operatively connected to said drill bit and selectively operable when activated for removing a different amount of material from the gage corner than that amount of material normally removed by said drill bit; and energizing means connected for activating said gage corner removal means over a selected partial interval of one rotation of said drill bit to remove a different amount of material from the gage corner over a selected partial arc the circumference of the gage corner, the selected arc corresponding in angular duration to the angular duration of the partial interval of one rotation, said energizing means being connected to said gate corner removal means for activating said gage corner removal means without operatively transmitting substantial lateral force through said connecting means.

21. In a rotary drill bit of the type comprising cutting elements for cutting a borehole in material defined by an axially extending cylindrical sidewall, a drill face extending generally transversely with respect to the cylindrical sidewall and a gage corner extending circumferentially from the drill face radially outward at an inclination to the cylindrical sidewall, in combination with an improvement comprising:

gage corner removal means connected to the drill bit and operatively associated with the drill bit cutting elements and selectively operable over a selected partial interval of rotation of the drill bit for removing different amount of material substantially only from the gage corner over a preselected partial arc of the circumference of the gage corner than that amount of material removed only by the cutting elements of said drill bit over the remaining partial arc of the circumference of the gage corner, said gage corner removal means maintaining substantially the same operable interaction of said bit cutting elements with the material when said removal means is operable as when said removal means is inoperable.

22. An invention as defined in claim 21 further comprising, in combination:

means for rotating said drill bit in contact with the drill face and gage corner of said borehole, energizing means for activating said removal means to an operative condition at approximately the same relative rotational positions and over approximately the same angular durations during a number of sequential revolutions of said drill bit.

23. An invention as defined in claim 21 further comprising:

energizing means operative relative to the rotational position of said drill bit for activating said removal means to an operative condition over corresponding partial intervals of a number of sequential revolutions of said drill bit.

24. An invention as defined in claim 23 wherein:

said energizing means activates said removal means over the same preselected arc during a plurality of consecutive revolutions of said drill bit, and also begins and terminates activation of said removal means at approximately the same respective rotational positions during revolutions of said drill bit.

25. An invention as defined in claim 24 wherein said energizing means activates said removal means during each of a plurality of consecutive revolutions.

26. An invention as defined in claims 18, 20 or 16 wherein said gage corner removal means comprises:

additional cutter means independently operable of said drill bit and operatively associated with said drill bit for selectively contacting and cutting additional material from the gage corner over the selected partial arc.

27. An invention as defined in claims 18, 20 or 16 wherein said gage corner removal means comprises:

pivotable connection means for operatively pivotably connecting said drill bit with the end of said drill string and for pivoting said drill bit about a point radially displaced from the axial center of said drill string, said pivotable connection means directly connecting said drill bit thereto; and means selectively pivoting said drill bit with respect to said drill string at the pivotable connector means.

28. An invention as defined in claims 18, 20 or 24 wherein said gage corner removal means further comprises:

a single cutting wheel member having a rotatable wheel-like cutting portion and an axle portion extending from said cutting portion, and means for rotatably connecting said cutting wheel to said drill bit and for positioning the axle portion of said cutting wheel member at intersecting angles with respect to both an axial and radial reference through said drill bit, and means for pivoting the axle portion to a lesser intersecting angle with respect to the axial reference.

29. An invention as defined in claims 10, 20 or 24 wherein said gage corner removal means further comprises:

fluid jet emitting means operatively associated with said drill bit for emitting pressurized fluid impinging essentially only on the gage corner material formed by said cutting elements.

30. An invention as defined in claims 18, 20 or 24 wherein said gage corner removal means further comprises:

particle delivery means associated with said drill bit for selectively directing drillable particles onto the selected partial arc of the circumference of the gage corner at a position rotationally in advance of cutting elements of said drill bit.

31. Apparatus for drilling a borehole defined in part by a sidewall, comprising a drill string, a rotary drill bit connected to an end of the drill string, means for rotating said drill string and said connected drill bit when inserted into the borehole, and an improvement comprising in combination:

at least one rotatable roller member connected to said drill string at a predetermined position axially spaced from said connected drill bit, the predetermined position being that position at which gravity induced sag in said drill string causes said roller member to contact the low side portion of the sidewall during a partial interval of one rotation of said drill string and to avoid contact with the sidewall during the remaining partial interval of the one rotation;

bearing means operatively connecting said roller member to rotate relative to the drill string and against the sidewall during the partial interval of contact of the roller member with the cylindrical sidewall;

energy generator means for generating energy upon operation; and connection means for connecting rotational movement of said roller member relative to said drill string for operating said energy generator means.

32. An invention as defined in claim 31 wherein:

said connection means connects said roller member in an exposed position on the exterior of said drill string to roll along the low side portion of the sidewall when in contact with the sidewall.

33. An invention as defined in claim 31 wherein said energy generator means comprises an electrical generator.

34. An invention as defined in claim 31 wherein said energy generator means comprises a hydraulic pump.

35. An invention as defined in claim 34 further comprising:

means associated with said drill string and said rotary drill bit for supplying drilling fluid to carry particle cuttings from the borehole in an outflow of drilling fluid and particle cuttings between the drill string and the cylindrical sidewall, and an inlet to said hydraulic pump opening into the outflow of drilling fluid and particle cuttings.

36. An invention as defined in claim 35 further comprising:

deflecting means operatively covering the inlet to said hydraulic pump for deflecting a predetermined size of particle cuttings from the outflow and directing the deflected particles into the inlet to said pump.

37. A rotary drill bit for selectively controlling the advancement angle of a borehole cut by rotating said drill bit against material, comprising:

a bit support structure;

a cutter assembly positioned on said bit support structure and comprising cutting elements arranged for cutting an axially extending cylindrical sidewall of the borehole and a drill face of the borehole extending transversely with respect to the sidewall and a gage corner of the borehole extending circumferentially from the drill face radially outward at an inclination to the sidewall; and particle delivery means attached to said bit structure for selectively delivering a different amount of drillable particles onto a selected partial arc of the circumference of the gage corner material during one revolution of said drill bit than the amount of drillable particles essentially present at the remaining partial arc of the circumference of the gage corner.

38. A rotary drill bit as defined in claim 37:

wherein said particle delivery means delivers the drillable particles onto the selected partial arc at a position essentially rotationally leading at least a portion of the cutter assembly, and said particle delivery means is operable only when activated; and further comprising activation means adapted for activating said particle delivery means only during a predetermined partial interval of one drill bit rotation.

39. Apparatus for selectively controlling the advancement angle of a borehole cut by rotating a drill bit against material, comprising:

a drill bit support structure;

a cutter assembly positioned on said bit support structure and comprising cutting elements arranged for cutting an axially extending cylindrical sidewall of the borehole, and a drill face of the borehole extending transversely with respect to the sidewall, and a gage corner of the borehole extending circumferentially from the drill face radially outward at an inclination to the sidewall;

particle means operatively associated with said drill bit and selectively activational for modifying the quantity of drillable particles encountered by said cutter assembly primarily only in the area of said gage corner and over only a selected partial arc of the circumference of the gage corner during each revolution of said drill bit; and activation means operatively connected to said particle means for activating said particle means over a selected portion of a revolution of said drill bit.

40. A rotary drill bit as defined in claims 38 or 39 further comprising:

a drill string connected to said bit support structure and adapted to be rotated and to rotate said drill bit;

energy deriving means positioned on said drill string to derive energy from rotation of said drill string relative to the cylindrical sidewall of said borehole, said energy deriving means fixed to said drill string at a predetermined position axially spaced from said connected drill bit at which gravity induced sag in said drill string causes said energy deriving means to contact the low side portion of said sidewall during an interval of one rotation of said drill string and to avoid contact with the sidewall during the remaining interval of the one rotation, said energy deriving means operatively deriving energy only during periods of contact with the sidewall of sad borehole; and means operatively conducting energy derived by said energy deriving means to said activation means, for rendering said activation means operative.

41. An invention as defined in claim 40:

wherein said bit support structure comprises means for washing cut particles of material away from the drill face and the gage corner and for conducting the cut particles of material in a fluid outflow between the drill string and the cylindrical sidewall;

wherein said particle delivery means comprises a particle flow tube member open at both ends and extending longitudinally along said bit support structure, one open end of said particle flow tube located at a position adapted to be adjacent to the gage corner material and rotationally in advance of the cutter assembly, the other open end of said particle tube located at a position axially displaced toward the drill string from the one open end; and further comprising means operatively associated with said particle flow tube for closing said particle flow tube to the outflow of fluid and cut particles during the partial interval of drill bit rotation and for opening said particle flow tube to the outflow of fluid and cut particles during the remaining interval of rotation.

42. An invention as defined in claim 41 wherein:

said energy deriving means is operatively connected to operate said opening and closing means.

43. An invention as defined in claim 40 wherein:

said bit support structure further includes means for washing cut particles of material away from the drill face and the gage corner and for conducting the cut particles of material in a fluid outflow between the drill string and the cylindrical sidewall; and said particle delivery means comprises a particle delivery tube member open at both ends and extending longitudinally along said bit support structure, one open end of said particle tube located at a position adapted to be adjacent to the gage corner material and rotationally in advance of the cutter assembly, the other open end of said particle tube being located at a position on the drill string axially displaced from said drill bit; and further comprising deflecting means for deflecting cut particles of material of a preselected size from the outflow of fluid and particles between the drill string and the cylindrical sidewall and for operatively supplying the selected size particles to said particle delivery tube.

44. An invention as defined in claim 43 wherein said deflecting means comprises:

a plurality of screen bars attached to the exterior of said drill string, the screen bars comprising a plurality of spaced-apart J-shaped bar members each extending toward the drill bit and into the outflow of fluid and cut particles and a U-shaped support bar attached to the drill string and to the J-shaped bars to define an intake opening space into which a portion of the outflow of fluid and cut particles is received, the size of the intake opening limiting the maximum size of particles entering said deflector means, and the space between J-shaped bars allowing particles less than the selected size to escape said deflector means.

45. An invention as defined in claim 40:

wherein said particle delivery means comprises a particle delivery tube open at one end and extending axially along said drill bit structure and partially along said drill string, the one open end of said particle delivery tube being attached in a rotationally advanced position of the cutter assembly and in a position adapted to be closely spaced from the gage corner of the borehole, the other end of said particle delivery tube longitudinally spaced from the one open end and on the drill string;

further comprising pump means connected to said particle delivery tube for forcing drillable particles into said particle delivery tube and out of the one open end end onto the gage corner upon activation of said pump means, said pump means including an intake opening; and further comprising means for supplying drillable particles to the intake opening of said pump means; and wherein said activation means is operatively connected for activating said pump means.

46. An invention as defined in claim 45 wherein said means for supplying drillable particles comprises:

a hopper receptacle attached to said drill string, said hopper receptacle adapted to receive and contain therein the drillable particles, and a conduit connecting said hopper receptacle to the intake opening of said pump means.

47. An invention as defined in claim 46 wherein said pump means comprises an auger member.

48. An invention as defined in claim 46 wherein said pump means comprises a screw-like rotor member operatively connected to rotate within a helical shaped stator member.

49. An invention as defined in claim 45 wherein:

said bit structure further includes means for washing cut particles of material away from the drill face and gage corner and for conducting the fluid and cut particles in a fluid outflow between the drill string and the cylindrical sidewall; and said means for supplying drillable particles comprises deflecting means for deflecting cut particles of a selected size from the outflow between the drill string and the cylindrical sidewall and for conducting the selected size particles into the intake opening of said pump means.

50. An invention as defined in claim 49 wherein said pump means comprises an auger member.

51. An invention as defined in claim 49 wherein said pump means comprises a screw-like rotor member operatively connected to rotate within a helical shaped stator member.

52. An invention as defined in claims 37 or 39 further comprising in combination:

a drill string connected to said drill bit and adapted to be rotated;

energy deriving means positioned on said drill string to derive energy from rotation of said drill string relative to the cylindrical sidewall of said borehole, said energy deriving means fixed to said drill string at a predetermined position axially spaced from said connected drill bit at which gravity induced sag in said drill string causes said energy deriving means to contact the low side portion of said sidewall during an interval of one rotation of said drill string and to avoid contact with the sidewall during the remaining interval of the one rotation, said energy deriving means operatively deriving energy only during periods of contact with the sidewall of said borehole;

pump means including an intake opening and and outlet opening, said pump means forcing fluid and particle cuttings from the outlet opening when operated;

means connecting said pump means for operation by said energy deriving means; and means for operatively conducting the forced fluid and particle cuttings from the inlet opening of said pump means to said particle means.

53. An invention as defined in claims 37 or 39:

wherein said cutter assembly comprises:

(a) an axially extending cylindrical sidewall cutting portion of said bit support structure, (b) a transversely extending drill face cutting portion of said bit support structure, (c) a substantially rounded corner cutting portion of said bit support structure, the corner cutting portion curving radially outward from the drill face cutting portion to the sidewall cutting portion, and (d) a plurality of inset cutting elements firmly attached to all of said cutting portions; and wherein said particle means comprises a particle discharge tube formed in said bit support structure, said particle discharge tube having a discharge opening from which drillable particles are delivered, the discharge opening formed in said curved corner cutting portion.

54. An invention as recited in claim 53 wherein said bit support structure further defines an axially extending cylindrical center opening.

55. A method of changing the angle of advancement of a borehole formed in material by a rotary drill bit having cutting elements for cutting the material and defining an axially extending cylindrical sidewall of the borehole, a drill face of the borehole extending essentially transversely with respect to the sidewall, and a gage corner of the borehole extending circumferentially from the drill face radially outward at an inclination to the cylindrical sidewall; said angle change method comprising:

providing drillable particles at the drill face and gage corner, and substantially modifying the amount of drillable particles primarily at a selected partial arc of the circumference of the gage corner as compared to the amount of drillable particles present at the remaining partial arc of the circumference of the gage corner.

56. A method as defined in claim 55 further comprising:

orienting the partial selected arc at approximately the same relative position during each of a plurality of revolutions of said drill bit.

57. A method as defined in claim 56 further comprising:

maintaining approximately the same circumferential duration of the partial selected arc during each of a plurality of revolutions of said drill bit.

58. A method as defined in claim 56 or 57 further comprising:

referencing the partial selected arc to a portion of the cylindrical sidewall of said borehole at a position axially spaced from the drill face and the gage corner.

59. A method as defined in claim 55 wherein substantially modifying the amount of drillable particles comprises:

controlling an outflow of cut material particles away from the gage corner at the selected partial arc of the circumference of the gage corner.

60. A method as defined in claim 55 wherein substantially modifying the amount of drillable particles comprises:

modifying an outflow of cut material particles away from the gage corner at the selected partial arc of the circumference of the gage corner, as compared to the outflow of cut material particles away from the remaining partial arc of the circumference of the gage corner.

61. A method as defined in claim 55 wherein substantially modifying the amount of drillable particles comprises:

removing particles of material cut by the cutting elements of said drill bit over the remaining partial arc more completely than the particles of material are removed over the selected partial arc.

62. A method as defined in claim 55 wherein substantially modifying the amount of drillable particles comprises:

delivering drillable particles over the selected partial arc in addition to material particles present from cutting by the cutting elements of said drill bit.

63. A method as defined in claim 62 further comprising:

obtaining the additional drillable particles from an outflow of particles of cut material removed from said borehole.

64. A method as defined in claim 63 further comprising:

obtaining the drillable particles from the outflow of particles at a position within the borehole axially spaced from the drill face and the gage corner.

* * * * *

UNITED STATES PATENT AND TRADEMARK OFFICE

CERTIFICATE OF CORRECTION

PATENT NO. : 4,211,292

DATED : July 8, 1980

INVENTOR(S) : Robert F. Evans

It is certified that error appears in the above-identified patent and that said Letters Patent are hereby corrected as shown below:

Column 3, line 64, delete "show" and substitute therefor--shoe--.

Column 6, line 45, delete "prove" and substitute therefor--proven--.

Claim 11, at column 29, line 11, delete "pl".

Claim 15, at column 29, line 64, delete "7" and substitute therefor--14--.

Claim 16, at column 30, line 5, delete "8" and substitute therefor--15--.

Claim 19, at column 30, line 62, delete "10" and substitue therefor--18--.

Claim 20, column 31, line 29, delete "gate" and substitute therefor--gage--.

Claim 26, at column 32, line 16, delete "16" and substitute therefor--24--.

Claim 27, at column 32, line 21, delete "16" and substitute therefor--24--.

UNITED STATES PATENT AND TRADEMARK OFFICE

CERTIFICATE OF CORRECTION

PATENT NO. :4,211,292

DATED : July 8, 1980

INVENTOR(S) : Robert F. Evans

It is certified that error appears in the above—identified patent and that said Letters Patent is hereby corrected as shown below:

Claim 29, at column 32, line 45, delete "10" and substitute therefor -- 18 --.

Signed and Sealed this

*Twenty-eighth* Day of *October 1980*

[SEAL]

*Attest:*

SIDNEY A. DIAMOND

*Attesting Officer*

*Commissioner of Patents and Trademarks*